US007578271B2

(12) United States Patent
Sugiura et al.

(10) Patent No.: US 7,578,271 B2
(45) Date of Patent: Aug. 25, 2009

(54) VALVE TIMING CONTROLLER

(75) Inventors: Taei Sugiura, Anjo (JP); Yasushi Morii, Nagoya (JP); Akiyuki Sudou, Takahama (JP)

(73) Assignee: DENSO CORPORATION, Kariya (JP)

( * ) Notice: Subject to any disclaimer, the term of this patent is extended or adjusted under 35 U.S.C. 154(b) by 248 days.

(21) Appl. No.: 11/705,516

(22) Filed: Feb. 13, 2007

(65) Prior Publication Data

US 2007/0199531 A1 Aug. 30, 2007

(30) Foreign Application Priority Data

Feb. 24, 2006 (JP) ..... 2006-049292
Oct. 6, 2006 (JP) ..... 2006-275511

(51) Int. Cl.
*F01L 1/34* (2006.01)

(52) U.S. Cl. ..... 123/90.15; 123/90.17; 464/160; 475/338

(58) Field of Classification Search ..... 123/90.15, 123/90.16, 90.17, 90.18; 464/1, 2, 160; 475/331, 475/338, 341

See application file for complete search history.

(56) References Cited

U.S. PATENT DOCUMENTS 7,281,507 B2 * 10/2007 Uehama et al. ..... 123/90.17
7,314,030 B2 * 1/2008 Uehama et al. ..... 123/90.17
7,377,242 B2 * 5/2008 Uehama et al. ..... 123/90.17

FOREIGN PATENT DOCUMENTS

DE 4110195 10/1992

* cited by examiner

*Primary Examiner*—Ching Chang
(74) *Attorney, Agent, or Firm*—Nixon & Vanderhye, PC

(57) ABSTRACT

A valve timing controller is provided with a first rotary element including a first gear part, a second rotary element including a second gear part, and a third rotary element including a third gear part and a fourth gear part. The third gear part and the fourth gear part are meshed respectively with the first gear part and the second gear part. A stopper is provided so as to extend in the first rotary element in the radial direction for regulating a relative rotational phase shift angle between the first rotary element and the second rotary element. An interposing assembler is provided on the second rotary element for rotatably interposing the stoppers in an axial direction.

19 Claims, 14 Drawing Sheets

VALVE TIMING CONTROLLER

CROSS-REFERENCE TO RELATED APPLICATION

This application is based on Japanese Patent Applications No. 2006-49292 filed on Feb. 24, 2006, and No. 2006-275511 filed on Oct. 6, 2006, the disclosures of which are incorporated herein by reference.

FIELD OF THE INVENTION

The present invention relates to a valve timing controller, and particularly to a valve timing controller for an internal combustion engine for controlling a valve timing of at least one of an intake valve and an exhaust valve which is opened/closed by a camshaft by torque transmitted from a crankshaft.

BACKGROUND OF THE INVENTION

There is conventionally known a valve timing controller for shifting a relative rotational phase between two rotary elements, which rotate respectively in response to the crankshaft and the camshaft, by a differential gear system composed mainly of a planetary gear.

For example, DE-4110195C2 discloses a valve timing controller which includes a sprocket as one rotary element rotating in response to a crankshaft, and a gear part as the other rotary element rotating in response to the camshaft, having a differential gear system composed mainly of a planetary gear between the sprocket and the other rotary element. Further, a stopper is provided in the sprocket and the gear part for regulating a phase shift angle of a relative rotational phase of the gear part to the sprocket. A planetary motion due to engagement of an internal gear part located in an inner wall of the sprocket and an external gear part located in the planetary gear of the gear part is converted into a relative rotational motion of the gear part to the sprocket. In addition, the gear part moves freely in the thrust direction to the sprocket and is nearly in a free state.

SUMMARY OF THE INVENTION

In the conventional art, the gear part and the sprocket are regulated of their phase shift angles, but the thrust direction movement is not regulated. There is, therefore, a possibility that the gear part and the sprocket are inclined comparatively largely in the thrust direction by transmission of the torque by the planetary motion of the external gear part and the internal gear part. In particular, when the relative rotational movement is performed in high velocity, there is a possibility that a minor irregular friction may be caused by colliding of the gear part with the sprocket. As a result, because of the generation of the minor irregular friction, there may be a possibility that the normal relative rotational movement state is not maintained.

Furthermore, since the gear part and the sprocket collide with each other in a state both of them being in inclined state, as described above, a stress is locally increased at the meshing teeth each other or the like, causing a factor of abrasion or damage.

The present invention is made in view of such circumstances, and an object thereof is to maintain a normal relative rotational movement by a planetary motion even when the relative rotational movement is performed in high velocity in the differential gear system mainly comprised of the planetary gear.

Moreover, another object of the present invention is to provide a valve timing controller capable of maintaining a normal relative rotational movement by the planetary motion, as well as of maintaining a normal operating state of an internal combustion engine, even when the relative rotational movement is operated in high velocity.

According to an aspect of the present invention, a valve timing controller is provided for controlling a valve timing of at least one of an intake valve and an exhaust valve which is opened/closed by a camshaft by torque transmitted from a crankshaft.

The valve timing controller has a first rotary element including a first gear part for rotating in response to one of the crankshaft and the camshaft, a second rotary element including a second gear part neighboring to the first gear part in the axial direction for rotating in response to the other of the crankshaft and the camshaft. The valve timing controller has a third rotary element including a third gear part and a fourth gear part. The third gear part and the fourth gear part are meshed respectively with the first gear part and the second gear part. The planetary motion of the third rotary element varies the relative rotational phase between the first rotary element and the second rotary element.

The valve timing controller further comprises a stopper radially extending in either one rotary element of the first rotary element and the second rotary element, for regulating a relative rotational phase shift angle between the first rotary element and the second rotary element. The valve timing controller further comprises an interposing assembler provided either at the other rotary element or between the other rotary element and the third rotary element for relatively rotatably interposing the stopper of the one rotary element in the axial direction.

In this way, it is possible to regulate the thrust direction movement of the one rotary element relative to the other rotary element through the stopper interposed by the interposing assembler in the axial direction, as well as to regulate the relative phase shift angle in these relative rotational movements.

Accordingly, even when the relative rotational movement is performed in high velocity, the normal relative rotational movement state by the planetary motion can be maintained without causing the minor irregular friction between the first rotary element and the second rotary element.

BRIEF DESCRIPTION OF THE DRAWINGS

Other objects, features, and advantages of the present invention will become more apparent from the following detailed description made with reference to the accompanying drawings, in which like portions are designated by like reference numbers and in which.

DETAILED DESCRIPTION OF EMBODIMENTS

Hereinafter, embodiments of the valve timing controller according to the present invention preferably implemented in a valve timing controller of an internal combustion engine (hereinafter referred to as "engine") will be described with reference to the drawings.

First Embodiment

Figure 1:
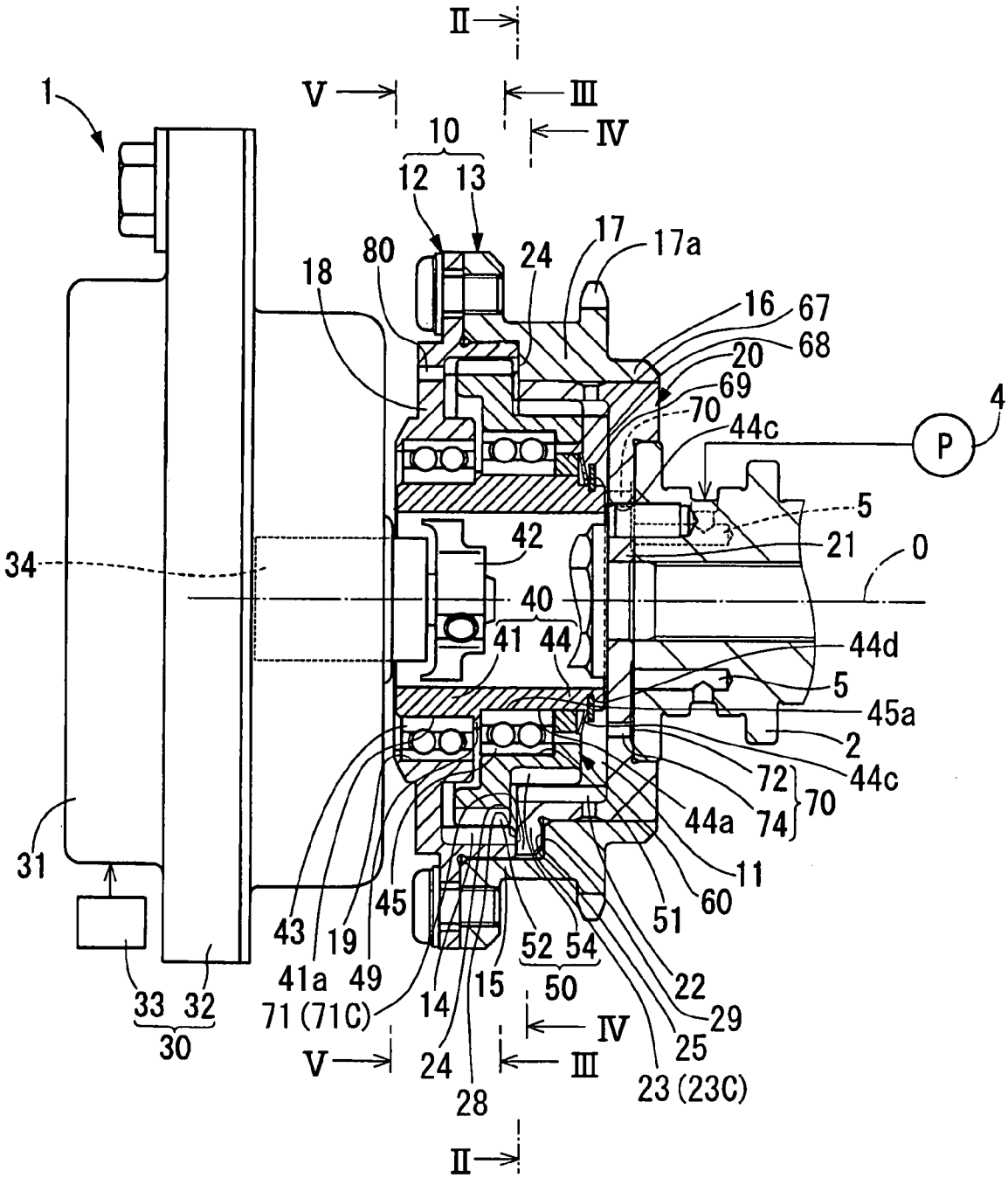
FIG. 1 is a cross section showing a valve timing controller according to a first embodiment of the present invention.

As shown in FIG. 1, a valve timing controller 1 is provided in a transmission system which transmits engine torque to a camshaft 2 from a crankshaft of the engine. The valve timing controller 1 adjusts the valve timing of an intake valve of the engine by shifting a relative rotational phase between the crankshaft and the camshaft 2.

The valve timing controller 1 is provided with a driving-side rotary element 10, a driven-side rotary element 20, a control unit 30, a planetary frame 40, and a planetary gear 50.

The driving-side rotary element 10 and the driven-side rotary element 20 jointly form an accommodating space 11 for the planetary frame 40, the planetary gear 50, and the like inside thereof.

Figure 3:
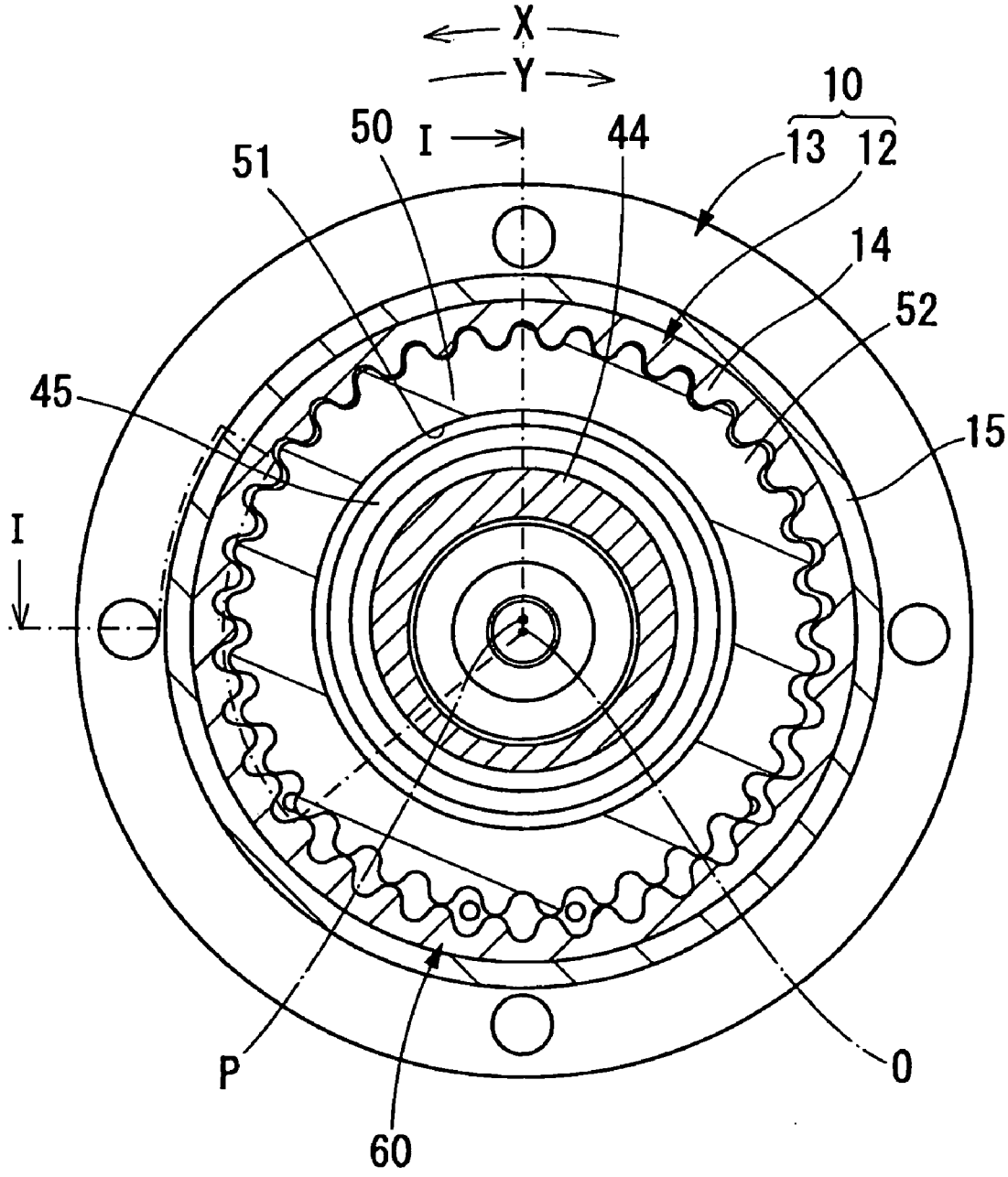
FIG. 3 is a cross sectional view of the valve timing controller taken along a line III-III in FIG. 1.

As shown in FIGS. 1 and 3, the driving-side rotary element 10 is constituted by coaxially assembling a tubular gear member 12 with a bottom and a two-stepped tubular sprocket 13. On a peripheral wall part of the gear member 12, a tip circle forms a driving-side internal gear part 14 existing on the inner peripheral side of a bottom circle. The gear member 12 is fixed by screwing to the sprocket 13 in a state where an outer peripheral wall of the driving-side internal gear part 14 is engaged with the inner peripheral wall of a larger diameter portion 15 of the sprocket 13. In a step part 17 connecting between the larger diameter portion 15 and a smaller diameter portion 16 in the sprocket 13, a plurality of teeth 17*a* are provided in a form extruding to the outer periphery side, and an annular timing chain is wound around between these teeth 17*a* and a plurality of teeth of the crankshaft. Therefore, when the engine torque outputted from the crankshaft is inputted into the sprocket 13 through the timing chain, the driving-side rotary element 10 moves with the crankshaft to rotate around a rotational axial line O keeping the relative phase relative to the corresponding axis. The rotational direction of the driving-side rotary element 10 is a counterclockwise direction in the present embodiment as shown in FIG. 3.

Figure 4:
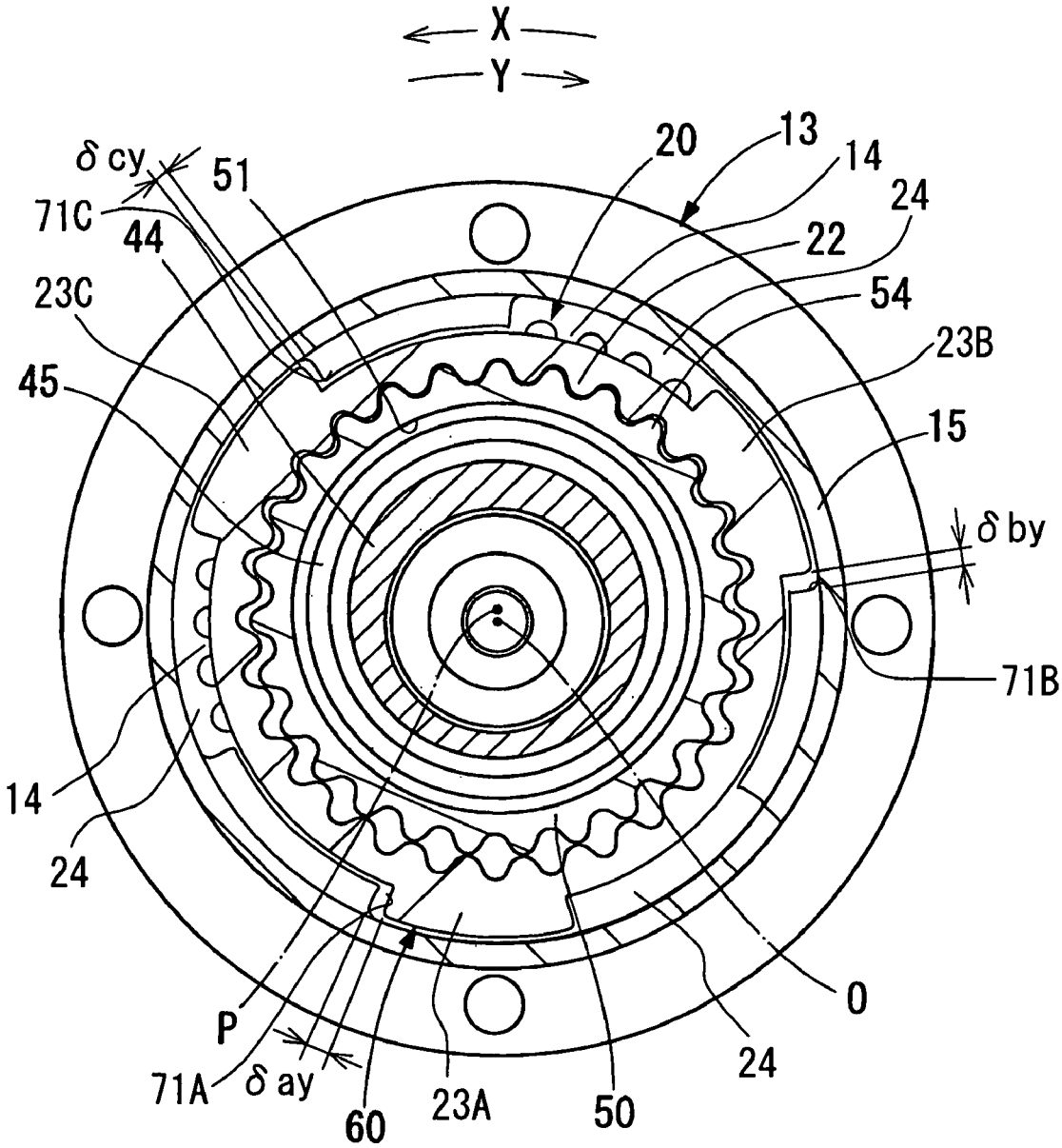
FIG. 4 is a cross sectional view showing the valve timing controller taken along a line IV-IV in FIG. 1.

As shown in FIGS. 1 and 4, the driven-side rotary element 20 is of a tubular type with a bottom, and is coaxially arranged with the driving-side rotary element 10 and the camshaft 2. A bottom wall part of the driven-side rotary element 20 forms a fixed portion 21 which is fixed by a bolt on an end part of the camshaft 2. By the bolt fixation, the driven-side rotary element 20 can rotate around the rotational axial line O keeping the relative rotational phase to the corresponding camshaft 2, moving together with the camshaft 2, and can rotate relative to the driving-side rotary element 10. The relative rotational direction toward which the driven-side rotary element 20 advances relative to the driving-side rotary element 10 is called advance direction X. The relative rotational direction toward which the driven-side rotary element 20 retards relative to the driving-side rotary element 10 is called retard direction Y.

The peripheral wall part of the driven-side rotary element 20 has a driven-side internal gear part 22, in which the tip circle exists on the inner periphery side of the bottom circle, formed thereon. Here, the inside diameter of the driven-side internal gear part 22 is set smaller than the inside diameter of the driving-side internal gear part 14. The number of the teeth of the driven-side internal gear part 22 is set smaller than the number of the teeth of the driving-side internal gear part 14. The outer peripheral wall of the driven-side internal gear part 22 is engaged with the smaller diameter portion 16 and the inner peripheral wall of the step part 17 in the sprocket 13, thereby the driven-side rotary element 20 relatively rotatably supports the driving-side rotary element 10 from the inner periphery side.

In the driven-side internal gear part 22, a flange part 23 protruding toward the outer periphery side is provided on an end part opposite to the fixed portion 21. The flange part 23 is interposed tightly between an end surface 24 of the driving-side internal gear part 14 and an end surface 25 of the step part 17, which oppose with each other in the axial direction. By this tightly interposed form, in the driven-side internal gear part 22, both surfaces 28 and 29 of the flange part 23 relatively rotatably contact with the end surfaces 24 and 25 facing toward the axial direction of the driving-side rotary element 10. The driven-side internal gear part 22 neighbors the driving-side internal gear part 14 with a deviation in the axial direction in a state where the axial direction relative displacement is regulated. The flange part 23 regulates the axial relative displacement and the relative rotational direction displacement of the driven-side internal gear part 22.

It should be noted that a structure of the flange part 23 which regulates the axial relative displacement and relative rotational direction displacement of the driven-side internal gear part 22 will be described later.

As shown in FIG. 1, a control unit 30 is comprised of an electric motor 32, an electric current control circuit 33. The electric motor 32 is arranged on the opposite side of the camshaft 2 with respect to the rotary elements 10 and 20. The electric motor 32 is an electric motor, for example, a brushless motor and the like, and includes a motor case 31 fixed to the engine via a stay (not shown) and a motor shaft 34 supported rotatably in direct and reverse directions by the motor case 31.

The electric current control circuit 33 is formed of an electric circuit such as a microcomputer and the like, is arranged outside or inside of the motor case 31, and is electrically connected with the electric motor 32. The electric current control circuit 33 controls an electric current flow to a coil (not shown) of the electric motor 32 in accordance with an operating condition and the like of the engine. By the electric current control, the electric motor 32 forms a rotating magnetic field around the motor shaft 34, and outputs rotating torque in the directions X and Y (refer FIG. 5) in accordance with the direction of the rotating magnetic field from the motor shaft 34.

Figure 5:
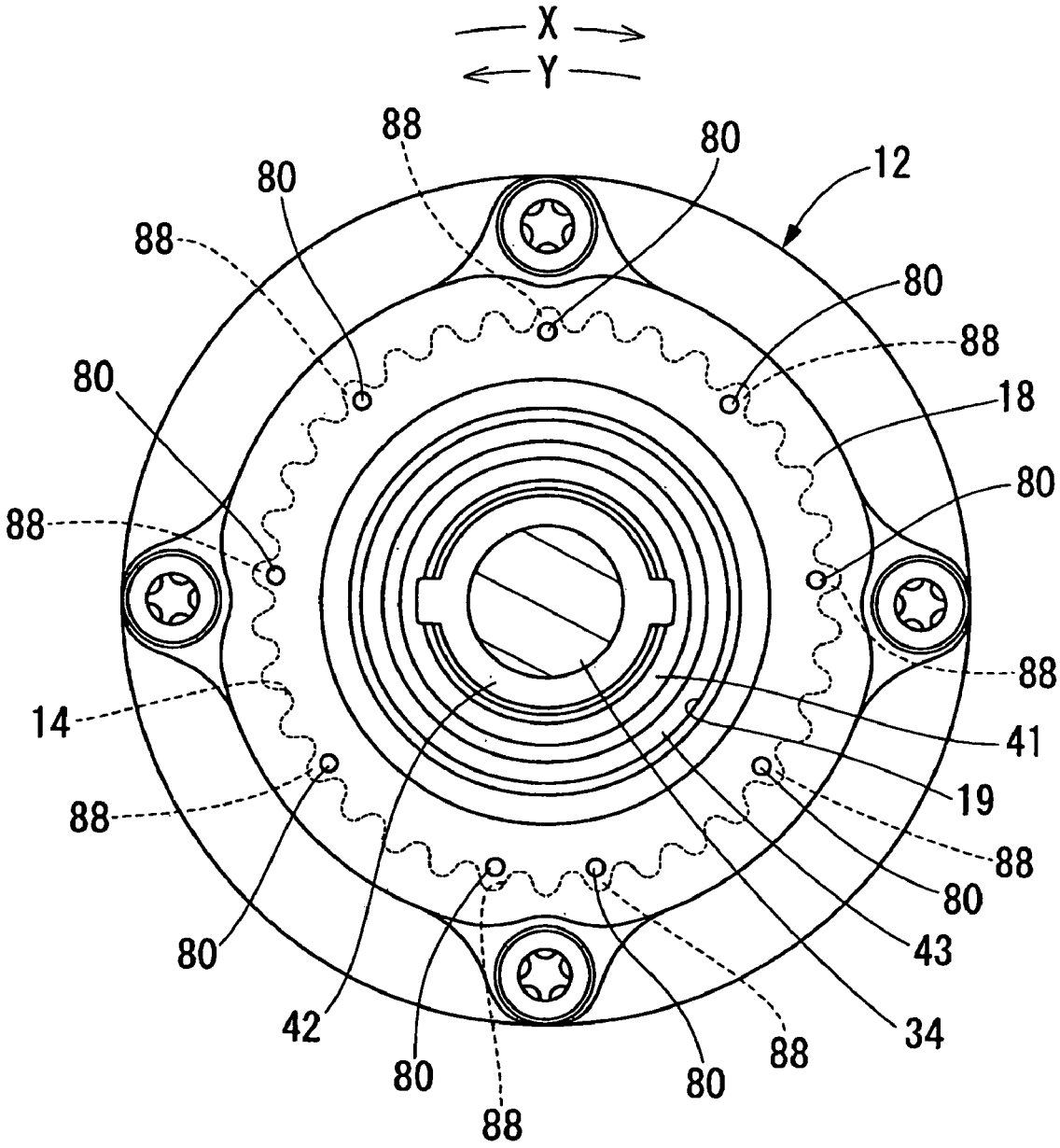
FIG. 5 is a cross section view showing the valve timing taken along a line V-V in FIG. 1.

As shown in FIGS. 1 and 5, an input part 41 of the planetary frame 40 is of a tubular type coaxial with the rotary elements 10, 20 and shafts 2, 34, and is fixed to the motor shaft 34 via a joint 42. By this fixing, the planetary frame 40 can rotate around the rotational axial line O moving together with the motor shaft 34, and can rotate relative to the driving-side rotary element 10. The input part 41 is arranged on the inner periphery side of a center hole 19 which axially penetrates through the bottom wall part 18 of the gear member 12, and supports the driving-side rotary element 10 through a bearing 43 from the inner periphery side of the center hole 19.

As shown in FIGS. 1 and 3, in the planetary frame 40, an eccentric part 44 which locates closer to the fixed part 21 than the input part 41 is of a tubular type in which the outer periphery wall is off-set relative to the rotary elements 10, 20 and shafts 2, 34. The eccentric part 44 is arranged on the inner periphery side of the center hole 51 which axially penetrates through the planetary gear 50, and supports the planetary gear 50 through the bearing 45 from the inner periphery side of the center hole 51. By this supporting, the planetary gear 50 can rotate around the eccentric axial line P which is the central axial line of the outer periphery wall of the eccentric part 44, and can rotate toward the rotational direction of the eccentric part 44. In other words, the planetary gear 50 is arranged to be capable of performing the planetary motion.

As shown in FIGS. 1 to 4, the planetary gear 50 is of a two-step tubular type, and the tip circle forms the driving side external gear part 52 and the driven side external gear part 54 existing on the outer periphery side of the bottom circle respectively by the larger diameter portion and the smaller diameter portion. Here, the number of the teeth of the driving side external gear part 52 is set smaller by a predetermined number N (one, in this embodiment) than the number of the teeth of the driving-side internal gear part 14. The number of the teeth of the driven side external gear part 54 is set smaller by the predetermined number N than the driven-side internal gear part 22. Accordingly, the number of the teeth of the driven side external gear part 54 is smaller than the number of the teeth of the driving side external gear part 52. The driving side external gear part 52 is arranged on the inner periphery side of the driving-side internal gear part 14, and meshed with a part of the gear part 14. Further, the driven side external gear part 54 which is located closer to the fixed part 21 than the driving side external gear part 52 is arranged on the inner periphery side of the driven-side internal gear part 22, and meshed with a part of the gear part 22.

Furthermore, as shown in FIG. 1, the eccentric part 44, which supports the planetary gear 50 through the bearing 45 from the inner periphery side of the center hole 51 are engaged with the bearing 45 by an clearance inlay. A clearance is formed between the outer periphery 44*a* of the eccentric part 44 and the inner periphery 45*a* of the bearing 45. Accordingly, the driving side external gear part 52 and the driven side external gear part 54 are movable in the axial direction between the driving-side internal gear part 14 and the driven-side internal gear part 22. The planetary gear 50 regulates a movement in one direction in the axial direction (left side in FIG. 1) by an engagement part 49 provided in the planetary frame 40 through the bearing 45.

It should be noted that in the embodiment described hereinafter, the planetary gear 50 and the bearing 45 are supported by the planetary frame 40 in a state the bearing 45 is contacted on the engagement part.

Further, on the opposite end of the engagement part 49 of the planetary gear 50, an engagement member 69 such as a snap ring or the like is provided on the outer periphery 44*a* of the planetary frame 40 through a spacer 67. The planetary gear 50 and the spacer 67 are interposed in the axial space between the engagement part 49 and the engagement member 69, for forming an axial clearance (thrust clearance) in the axial space. By selecting an axial width of the spacer 67 at a predetermined width, the axial clearance (thrust clearance) is formed as a prescribed clearance.

Figure 6:
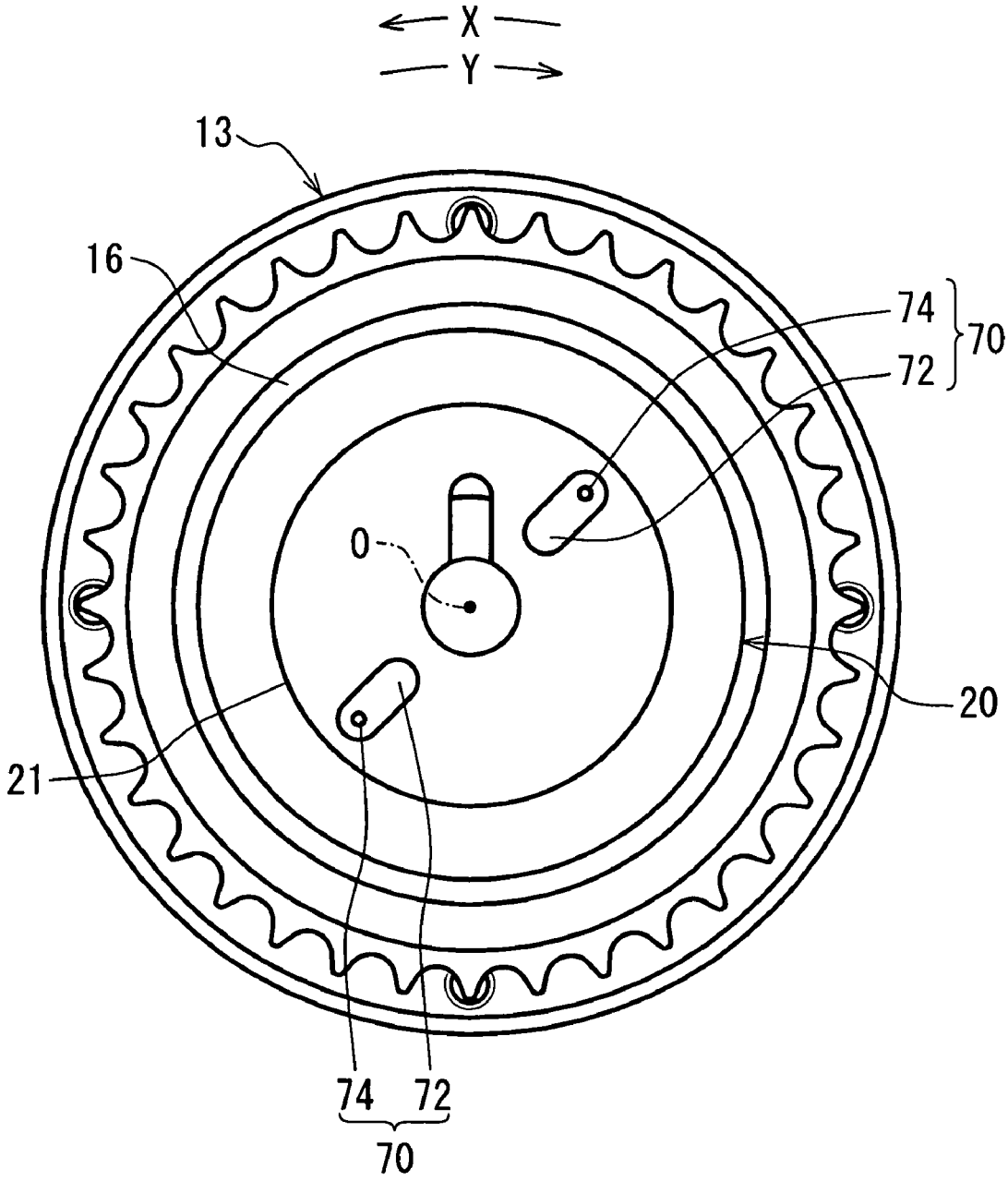
FIG. 6 is a side elevation view showing the valve timing controller.

It should be noted here that two guide holes 70 are formed on the fixed part 21 to guide a lubricating oil for the engine which is a lubricating fluid into an inside space 11 of the rotary elements 10 and 20, as shown in FIGS. 1 and 6. These guide holes 70 are respectively provided at two locations which are symmetrical each other with respect to the rotational axial line O, and are arranged at equal intervals in the circumferential direction of the fixed part 21 which coincides with the common circumferential direction of the internal gear parts 14 and 22. At respective guide holes 70, upstream side orifice parts 72 are long and in a flat slotted-hole shape in the radial direction of the fixed part 21. Here, the entrance parts of the orifice part 72 are communicated with a corresponding one out of two supply holes 5 to which the lubricating oil is discharged for supplying from a pump 4 in the camshaft 2, and a flow-path area of the orifice part 72 is more reduced than the flow-path area of the corresponding supply hole 5.

Furthermore, a guide part 74 located at the downstream side of the orifice part 72 in each guide hole 70 is in a tubular-hole shape extending in the axial direction of the fixed part 21. Here, an outlet part of the guide part 74 is open further toward the inner peripheral side than a tip circle 86 of the driven-side internal gear part 22, thereby communicating with the inside spaces 11 of the rotary elements 10 and 20.

As shown in FIGS. 1, and 5, in the gear member 12, nine discharge holes 80 for discharging the lubricating oil to the outside from the inside spaces 11 are formed at a bottom wall part 18 located at the opposite side of the fixed part 21 interposing the differential gear system 60. These discharge holes 80 are mutually arranged with prescribed intervals in the circumferential direction of the bottom wall part 18 which coincides with the common circumferential direction of the internal gear parts 14 and 22, and respectively exhibit tubular hole shape penetrating through the bottom wall part 18 in the axial direction. Here, the outlet part of the discharge hole 80 is open toward the outside space between the bottom wall part 18 and the electric motor 32. Moreover, the entrance part of the discharge hole 80 is open toward a tooth groove 88 of the driving-side internal gear part 14, thereby communicating with the inside space 11.

By the arrangement described above, in the inside space 11 of the rotary elements 10 and 20, the differential gear system 60 which is formed by combining the driving-side internal gear part 14 with the driven-side internal gear part 22 through the planetary gear 50 is formed on the outer periphery side of the eccentric part 44. Then, in the differential gear system 60, when the planetary frame 40 does not rotate relative to the driving-side rotary element 10, the planetary gear 50 rotates together with the rotary elements 10 and 20 while maintaining meshed positions of the external gear parts 52 and 54 with the internal gear parts 14 and 22. As a result, the relative rotational phase between the rotary elements 10 and 20 is maintained, thus the valve timing is also maintained. On the other hand, when the planetary frame 40 is rotated in the advance direction X with an increase of the rotational torque in the X direction, the driven-side rotary element 20 rotates in the advance direction X.

Accordingly, the valve timing is shifted toward the advance side. Furthermore, when the planetary frame 40 is relatively rotated in the retard direction Y due to the increase of the rotational torque in the Y direction and an abrupt stop of the electric motor 32, the driven-side rotary element 20 rotates in the retard direction Y relative to the driving-side rotary element 10, by operating the planetary gear 50 in the planetary motion while shifting the meshing positions of the external gear parts 52 and 54 with the internal gear parts 14 and 22. Accordingly, when the valve timing is shifted toward the retard side, and particularly when the electric motor 32 is abruptly stopped, the valve timing of the most retard phase which enables starting of the internal combustion engine can be realized.

A characteristic portion of the valve timing controller 1 will be described in more detail.

Figure 2:
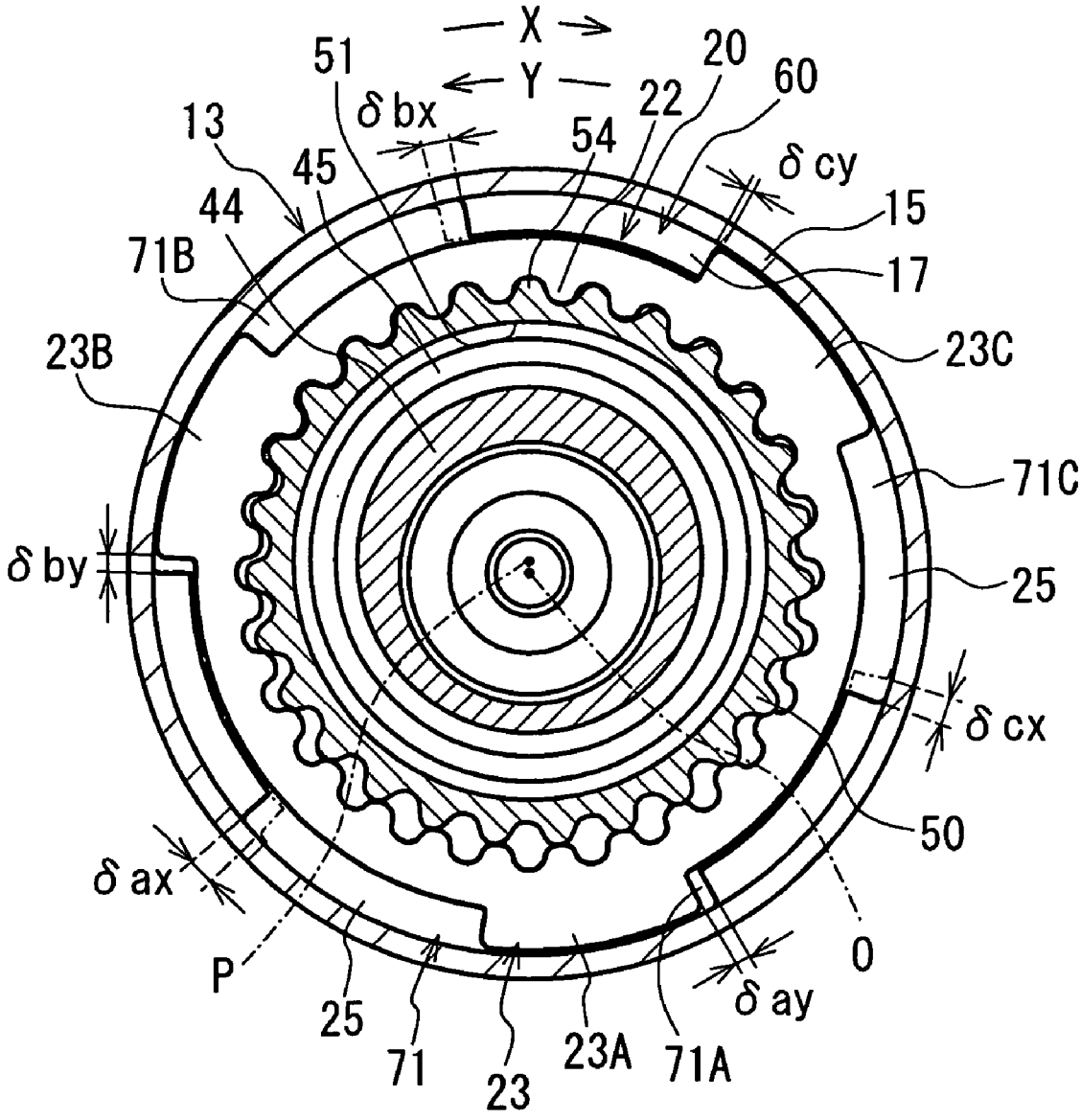
FIG. 2 is a cross sectional view of the valve timing controller taken along a line II-II in FIG. 1.

A flange part 23 of the driven-side internal gear part 22 is, as shown in FIGS. 1 and 2, constituted of circular protrusion parts (hereinafter referred to as "stoppers") 23A, 23B, and 23C in the circumferential direction.

As shown in FIGS. 1 and 2, a flange groove 71 extending in the circumferential direction along the inner periphery thereof is provided on the inner periphery part of the inner wall of the driving-side rotary element 10. The flange groove 71 is circularly open toward the outer periphery of the driven-side internal gear part 22, as shown in FIG. 2. The flange groove 71 is constituted of three pieces of the circular guide grooves (hereinafter referred to as "stopper grooves") 71A, 71B, and 71C which interposes the respective stoppers 23A, 23B, and 23C in the opening part.

In particular, the respective stopper grooves 71A, 71B, and 71C are formed, as shown in FIG. 1, on the inner periphery of the step part 17 of the sprocket 13 in the driving-side rotary element 10 having the gear member 12 and the sprocket 13. The respective stopper grooves 71A, 71B, and 71C are, as shown in FIGS. 1, 2, and 4, formed by being partitioned by the axial end surface 25 of the groove and an axial end surface 24 of the driving-side internal gear part 14. As a result, the axial end surface 24 of the driving-side internal gear part 14 can be used as a thrust receiving surface of the stoppers 23A, 23B, 23C, while having the driving-side internal gear part 14, of the driving-side rotary element 10 neighbored in the axial direction to the driven-side internal gear part 22 having the stoppers 23A, 23B, 23C of the driven-side rotary element 20. Accordingly, when the driving-side rotary element 10 is formed by assembling the gear member 12 with the sprocket 13, the stoppers 23A, 23B, and 23C of the driven-side rotary element 20 can be easily interposed.

However, the stoppers 23A, 23B, and 23C preferably extend circularly along the relative rotational direction of the driving-side rotary element 10 and the driven-side rotary element 20. Thereby the relative rotational phase of the driving-side rotary element 10 relative to the driven-side rotary element 20 can be smoothly shifted within the range of the relative rotational shift angle.

Further, the stoppers 23A, 23B, and 23C are arranged over the circumferential direction, and thereby the thrust direction movement of the driven-side rotary element 20 having the stoppers described above can be stably regulated relative to the driving-side rotary element 10.

When the multiple stoppers described above are arranged over the circumferential direction, it is preferable that the stoppers 23A, 23B, and 23C are arranged substantially at equal intervals over the entire circumference. Thereby the thrust clearance, which indicates a thrust direction movement quantity of the driven-side rotary element 20 relative to the driving-side rotary element 10, can be made uniform over the entire circumference in the relative rotational direction.

The respective stoppers 23A, 23B, and 23C protrude in the inside of the stopper grooves 71A, 71B, and 71C, and extend shorter than the lengths in the circumferential direction of the respective stopper grooves 71A, 71B, and 71C, which are formed in predetermined circular shapes. The respective stoppers 23A, 23B, and 23C are movable in the circumferential direction in the respective stopper grooves 71A, 71B, and 71C, and are capable of shifting the relative rotational phases relative to the respective stopper grooves 71A, 71B, and 71C.

The shifting possible angle of the relative rotational phase (hereinafter referred to as "relative rotational phase shift angle") of each stopper 23A, 23B, 23C relative to each stopper groove 71A, 71B, 71C is determined by the difference in the circumferential length between the stopper groove 71A, 71B, 71C and each stopper 23A, 23B, 23C.

However, in the relatively rotating rotary elements 10, 20, the respective stoppers 23A, 23B 23C may simultaneously collide with the circumferential end surfaces of the respective stopper grooves 71A, 71B, 71C in the advance direction X and the retard direction Y. Alternatively, one pair out of respective pairs of the stoppers 23A, 23B, 23C and the stopper grooves 71A, 71B, 71C may collide therebetween.

In the description of the embodiment hereinafter, one pair composed of the stopper 23C and the stopper groove 71C collides in the advance direction X and the retard direction Y. As shown in FIG. 2, in a case that the clearances of the circumferential direction length between the stoppers 23A, 23B, 23C and the stopper grooves 71A, 71B, 71C are set at $\delta ay$, $\delta by$, and $\delta cy$ in the retard direction Y, the clearances $\delta ay$, $\delta by$, and $\delta cy$ are set such that, when it is set at $\delta cy=0$ where the stopper 23C collides with the stopper groove 71C, other pairs are set to have the clearances expressed by $\delta ay>0$ and $\delta by>0$. Furthermore, similarly, in the advance direction X, if they are set at $\delta ax$, $\delta bx$, and $\delta cx$, when it is set at $\delta cx=0$ where the stopper 23C collides with the stopper groove 71C, the other pairs are set to have the clearances expressed by $\delta ax>0$ and $\delta bx>0$.

In this way, the stopper 23C and the stopper groove 71C regulate the relative phase shift angle in the relative rotational movement of the driving-side rotary element 10 and the driven-side rotary element 20.

It should be noted that the sizes of the clearances between $\delta ay$ and $\delta by$, and $\delta ax$ and $\delta bx$ may have values which are substantially the same or different. Furthermore, the difference of $\delta ay$, the difference between $\delta by$ and $\delta ay$, the difference of $\delta ax$ and the difference between $\delta bx$ and $\delta ax$ are preferably set within a range of a predetermined difference. Thereby, in addition to the pair of the stopper 23C and the stopper groove 71C, even in other pairs of the stoppers 23A and 23B of the stopper grooves 71A and 71B, a function of regulating the relative phase shift angle in the relative rotational movement of the element 10 and the element 20 can be achieved. Accordingly, with the stoppers 23A, 23B, 23C and the stopper grooves 71A, 71B, 71C in these pairs, reliability of the function of regulating the relative phase shift angle described above can be improved.

Even if there is a case where, for example, the stopper 23C of one pair are damaged or the like, since the relative phase shift angle can be regulated by the stoppers 23A and 23B of the other pairs, normal operating state of the engine can be maintained. It should be noted that, here, the predetermined difference means a prescribed difference which can maintain the normal operating state of the engine, even when a deviation of the relative rotational shift angle is caused by the difference of $\delta ay$, and the difference with $\delta ax$.

Moreover, in the embodiment, the respective stoppers 23A, 23B, 23C are preferably arranged substantially at equal intervals over the entire circumferential in the relative rotational direction.

Furthermore, in the embodiment, an urging member 68 for urging the planetary gear 50 toward the engagement part 49 is preferably provided. In particular, the urging member 68 is formed of a spring member, for example, a coned disc spring or the like, and is interposed between the spacer 67 and the engagement member 69. In the following description of the present embodiment, the coned disc spring is used as the urging member 68.

The urging member 68 is formed on the substantially annular-shaped coned disc spring, and the inner periphery 68*a* thereof is removably mounted on an outer periphery 44*c* for engagement use formed on a right end side of the outer periphery 44*a* of the eccentric part 44. Further, the engagement member 69 is arranged to be mounted on the step part 44*d* formed on the outer periphery 44*c*, and the urging member 68 is interposed between the spacer 67 and the engagement member 69, namely in an axial clearance (thrust clearance), by mounting and engaging the engagement member 69 to the step part 44*d*. As a result, the axial clearance (thrust clearance) is buried by spring deflection of the urging member 68.

In the embodiment described above, on the sprocket 13 of the driving-side rotary element 10, a thrust groove 71C is provided to accommodate the driven-side rotary element 20 so as to relatively rotate thereto and interposes the driven-side internal gear part 22 in the axial direction. On the driven-side internal gear part 22, the stopper 23C is provided to circularly extend along the inside of the thrust groove 71C and enable a predetermined relative phase shift angle.

By such arrangement, the relative phase shift angle in the relative rotational movement of the element 10 and the element 20 is regulated by the stopper 23C and the thrust groove 71C. The thrust direction movement of the driven-side rotary element 20 relative to the driving-side rotary element 10 can be regulated through the stopper 23 circularly extending along the inside of the thrust groove 71C.

Accordingly, even when the relative rotational movement is performed in high velocity, the minor irregular friction between the driving-side rotary element 10 and the driven-side rotary element 20 does not occur, and the normal relative rotational movement state by the planetary motion can be maintained.

Furthermore, in the embodiment, the stopper groove 71C is arranged to have an opening so as to extend in the circumferential direction along the inner periphery part of the driving-side rotary element 10. Hence, it can be made as the guide groove of a circular type, which opens within a predetermined circumferential range along the inner periphery of the inner peripheral part of the driving-side rotary element 10. Thereby the relative rotational movement can be regulated on the circumferential end surface inside the thrust groove 71C relative to the stopper 23C which relatively rotates along the inside of the thrust groove 71C. The relative phase shift angle in the relative rotational movement can be regulated by the stopper 23C and the thrust groove 71C.

Moreover, in the embodiment, a plurality of the pairs of the thrust grooves 71A, 71B, 71C and the stoppers 23A, 23B, 23C are preferably provided (three pairs in the embodiment).

Consequently, in addition to the pair of the stopper 23C and the stopper groove 71C described above, even in the other pairs of the stoppers 23A, 23B and the stopper grooves 71A, 71B, the function of regulating the relative phase shift angle in the relative rotational movement of the driving-side rotary element 10 and the driven-side rotary element 20 can be achieved. Accordingly, the stoppers 23A, 23B, 23C and the stopper grooves 71A, 71B, 71C of these pairs can improve the reliability of the function of regulating the relative phase shift angle described above. Even if there is a case where the stopper 23C of the one pair is damaged, the normal operating state of the engine can be maintained, since the relative phase shift angle can be regulated by the stoppers 23A, and 23B of the other pairs.

Further, in this case, it is preferable that a function to detect a deviation relative to the predetermined relative phase shift angle is provided on the control device such as the control unit 30. Thereby the deviation described above which is caused by the fact that the relative phase shift angle is regulated by at least one of the stopper 23A and the stopper 23B of the other pairs, can be detected and thus a failure such as damage of the stopper 23C can be detected.

Furthermore, in the plurality of pairs of the thrust grooves 71A, 71B, 71C, and the stopper 23A, 23B, 23C, respective stoppers 23A, 23B, 23C are preferably arranged at substantially equal intervals over the entire circumference in the relative rotational direction. Thereby the thrust clearance indicating the thrust direction movement quantity of the driven-side rotary element 20 relative to the driving-side rotary element 10 can be made uniform over the entire circumference in the relative rotational direction.

Moreover, in the embodiment, respective stopper grooves 71A, 71B, 71C are formed on the inner periphery of the step part 17 of the sprocket 13 in the driving-side rotary element 10 having the gear member 12 and the sprocket 13, which is dividable into two in the axial direction. The respective stopper grooves 71A, 71B, 71C are formed so as to be defined by the axial end surfaces 25 of the grooves thereof and the axial direction end surfaces 24 of the driving-side internal gear part 14. Accordingly, the axial end surface 24 of the driving-side internal gear part 14 can be used as the thrust receiving surface of the stoppers 23A, 23B, 23C, while neighboring the driving-side internal gear part 14 to the driven-side internal gear part 22 having the stoppers 23A, 23B, and 23C in the axial direction. By such arrangement, a relatively simple, two-dividable structure can be made as a division assembling structure for providing the thrust groove, while dividing the driven-side rotary element 20 into two parts in the axial direction.

Accordingly, when the driving-side rotary element 10 is formed by assembling the gear member 12 and the sprocket 13, the stoppers 23A, 23B, 23C of the driven-side rotary element 20 can be easily interposed.

In the embodiment described above, the driving side external gear part 52 and the driven side external gear part 54 of the planetary gear 50 are provided with the planetary frame 40 which enables axial movement between the driving-side internal gear part 14 and the driven-side internal gear part 22 inside the rotary elements 10, 20. However, they may be structured so as to provide the urging member 68 which is disposed in the thrust clearance (hereinafter referred to as "second thrust clearance") existing between the planetary frame 40 and the planetary gear 50. Accordingly, when the external gear parts 52 and 54 are integrally operated in the planetary motion while meshing the external gear parts 52, 54 with the internal gear parts 14, 22, the thrust direction movement of the planetary gear 50 can be effectively restrained by the urging member 68.

Further, in the embodiment, since the planetary gear 50 is urged by the urging force of the urging member 68 so as to remove the second thrust clearance described above, the second thrust clearance can be set within an clearance range in which the urging force of the urging member 68 is generated. Therefore, it is not necessary to increase the part processing precision in order to make the second thrust clearance smaller.

Furthermore, the embodiment is structured so as to interpose the planetary gear 50 between the engagement part 49 and the urging member 68, and thus the urging force of the urging member 68 can be surely added to the planetary gear 50. Accordingly, the thrust movement of the planetary gear 50 performing an eccentric movement can be effectively restrained by the urging force generated in the urging member 68.

Second Embodiment

Hereinafter, descriptions are made about other embodiments to which the present invention is applied. In the embodiments described hereunder, components identical or equivalent to those in the first embodiment are referred to as identical numerals and the descriptions thereof are not repeated.

The first embodiment is described such that the stoppers 23A, 23B, and 23C of the driven-side rotary element 20 are directly interposed between the gear member 12 and the axial end surfaces 24 and 25 of the sprocket 13.

Figure 7:
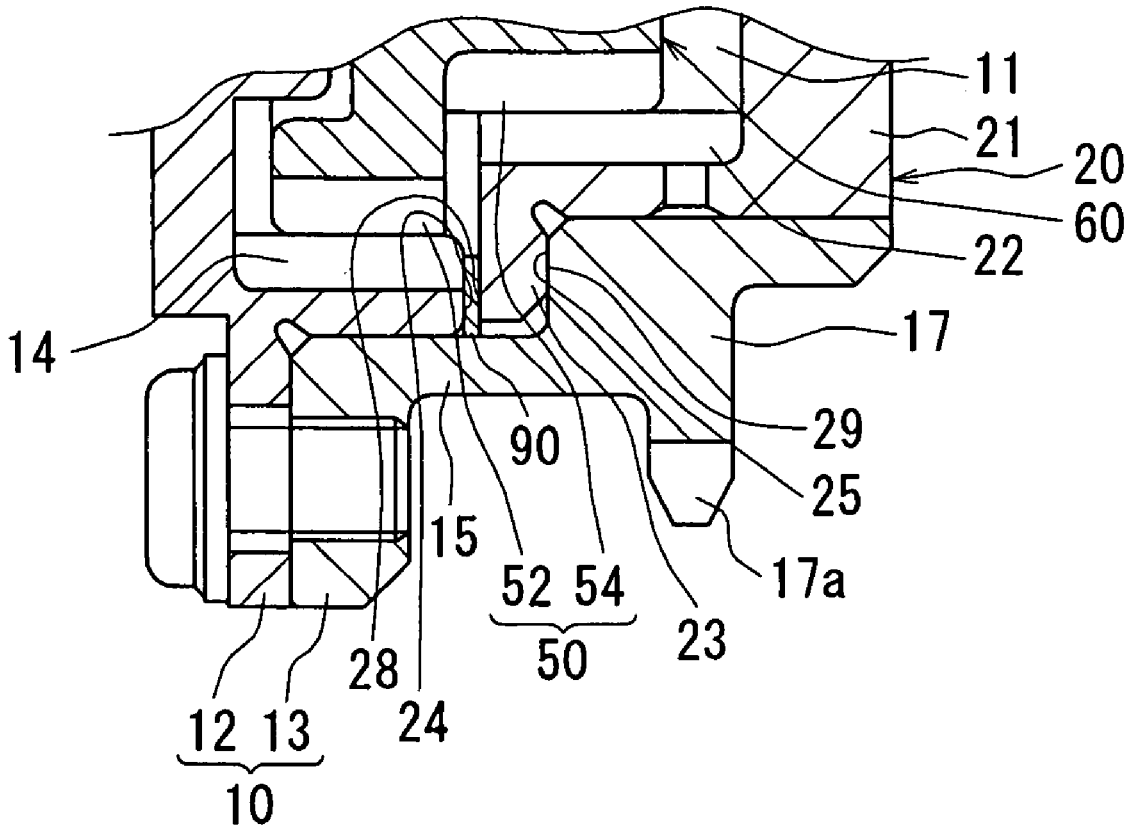
FIG. 7 is a partial cross section showing a valve timing controller according to a second embodiment of the present invention.

Contrary to this, the second embodiment is, as shown in FIG. 7, structured such that a clearance adjusting member 90 is provided to be interposed into a clearance between the axial end surface 25 and the stoppers 23A, 23B, and 23C in a space between the axial end surfaces 24 and 25 above described. FIG. 7 is a partial Gross section showing the valve timing controller according to the second embodiment.

As shown in FIG. 7, the clearance adjusting member 90 such as an annular shim or the like is provided in a clearance between the axial direction end surface 24 of the driving-side internal gear part 14 and the stopper 23C. The clearance adjusting member 90 is interposed in an axial space between the axial end surface 24 and the axial end surface 25 through the stopper 23C. The clearance adjusting member 90 forms a thrust clearance in the axial space.

Even if thus arranged, the same advantages as the first embodiment can be obtained.

Further, in the embodiment, the thrust clearance can be formed in a prescribed clearance by selecting an axial width of the clearance adjusting member 90 in a predetermined width, making it unnecessary to increase the part processing precision for making the second thrust clearance smaller.

Furthermore, the second embodiment is structured such that the clearance adjusting member 90 is interposed in the axial end surface 24 of the driving-side internal gear part 14. The clearance adjusting member 90 can be formed in a simple shape such as an annular shape, since the thrust receiving surface thereof is not influenced by the shape of the thrust grooves 71A, 71B, 71C.

Third Embodiment

In the first embodiment, the thrust direction movement of the driven-side rotary element 20 relative to the driving-side rotary element 10 through the stopper 23 is regulated by interposing the stopper 23 into the thrust groove 71 formed along the inner periphery part of the driving-side rotary element 10 in the axial direction.

Figure 8:
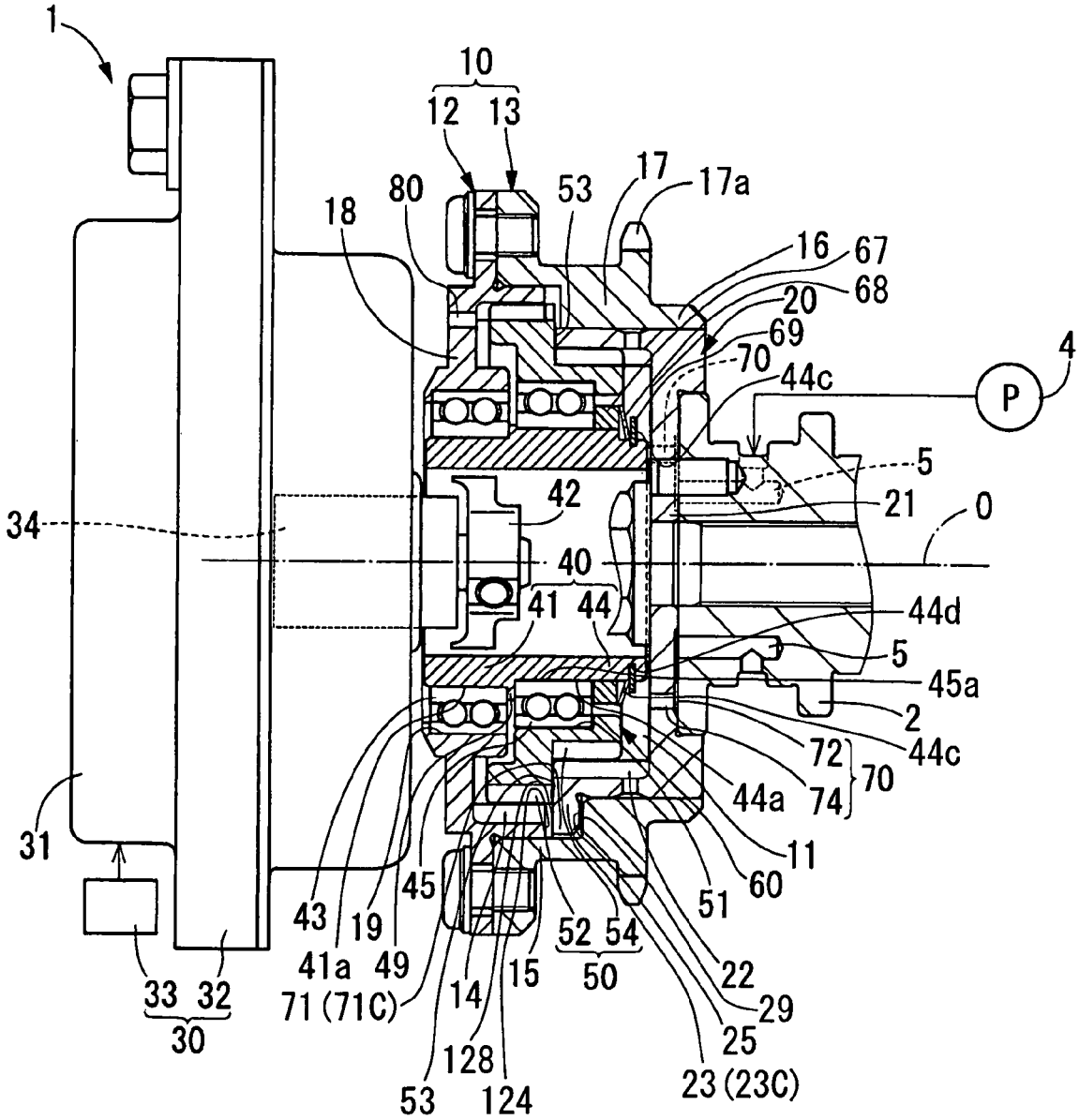
FIG. 8 is a cross section showing a valve timing controller according to a third embodiment of the present invention.

Alternatively, in the third embodiment, as shown in FIG. 8, the stopper 23 is arranged to be interposed by the planetary gear 50 in a state the stopper 23 is accommodated in the thrust groove 71.

The stoppers 23A, 23B, 23C of the driven-side rotary element 20 are guided to the thrust grooves 71A, 71B, 71C of the driving-side rotary element 10, and are accommodated in the respective thrust grooves 71A, 71B, and 71C. It should be noted that only one pair of the stopper 23C and the thrust grooves 71C is shown in FIG. 8. Hereinafter, description is made of the one pair of the stopper 23C and the thrust groove 71C, and the descriptions of the other pairs are omitted.

As shown in FIG. 8, an axial direction end surface 124 of the driving-side internal gear part 14 out of the axial direction end surfaces 124 and 25 of the thrust groove 71C is spaced from the stopper 23C in order not to contact with the end surface 128 of the stopper 23C. Further, the axial end surface 53 of the driving side external gear part 52 of the planetary gear 50 is arranged so as to be contactable on the end surface 128 of the stopper 23C.

In other words, an clearance between the axial end surface 53 and the end surface 128 is set smaller than the clearance between the axial end surface 124 and the end surface 128. The axial end surface 53 serves as a thrust receiving surface of the stopper 23C.

By such arrangement, the stoppers 23A, 23B, 23C can be interposed in the axial direction by the interposing assembler composed of the driving-side rotary element 10 and the planetary gear 50. In other words, the stopper 23A, 23B, 23C can be interposed in the axial direction by the thrust grooves 71A, 71B, 71C, and the axial end surface 53 of the planetary gear 50. The advantage which is the same as that of the first embodiment can be also obtained even in such arrangement described above.

Furthermore, in the third embodiment, the planetary gear 50 (in detail, the axial end surface 53 of the driving side external gear part 52) achieves the function of the thrust-receiving surface of the stoppers 23A, 23B, 23C in the planetary gear 50 accommodated between the element 10 and the element 20. A predetermined clearance can be secured between the planetary frame 40 of the planetary gear 50 and the fixed part 21 of the driven-side rotary element 20, as shown in FIG. 8.

Moreover, the third embodiment is preferably structured so as to provide the urging member 68 for reducing the thrust clearance existing between the planetary frame 40 and the planetary gear 50. Thereby the planetary gear 50 having the external gear parts 52 and 54 is restrained of its thrust direction movement by the urging member 68 when the external gear parts 52 and 54 perform the planetary motion in integration while meshing the external gear parts 52 and 54 with the internal gear parts 14 and 22.

Fourth Embodiment

In the third embodiment, the thrust receiving surface of the planetary gear 50 which interposes the stoppers 23A, 23B, and 23C is formed of the axial direction end surface 53 of the driving side external gear part 52.

Figure 9:
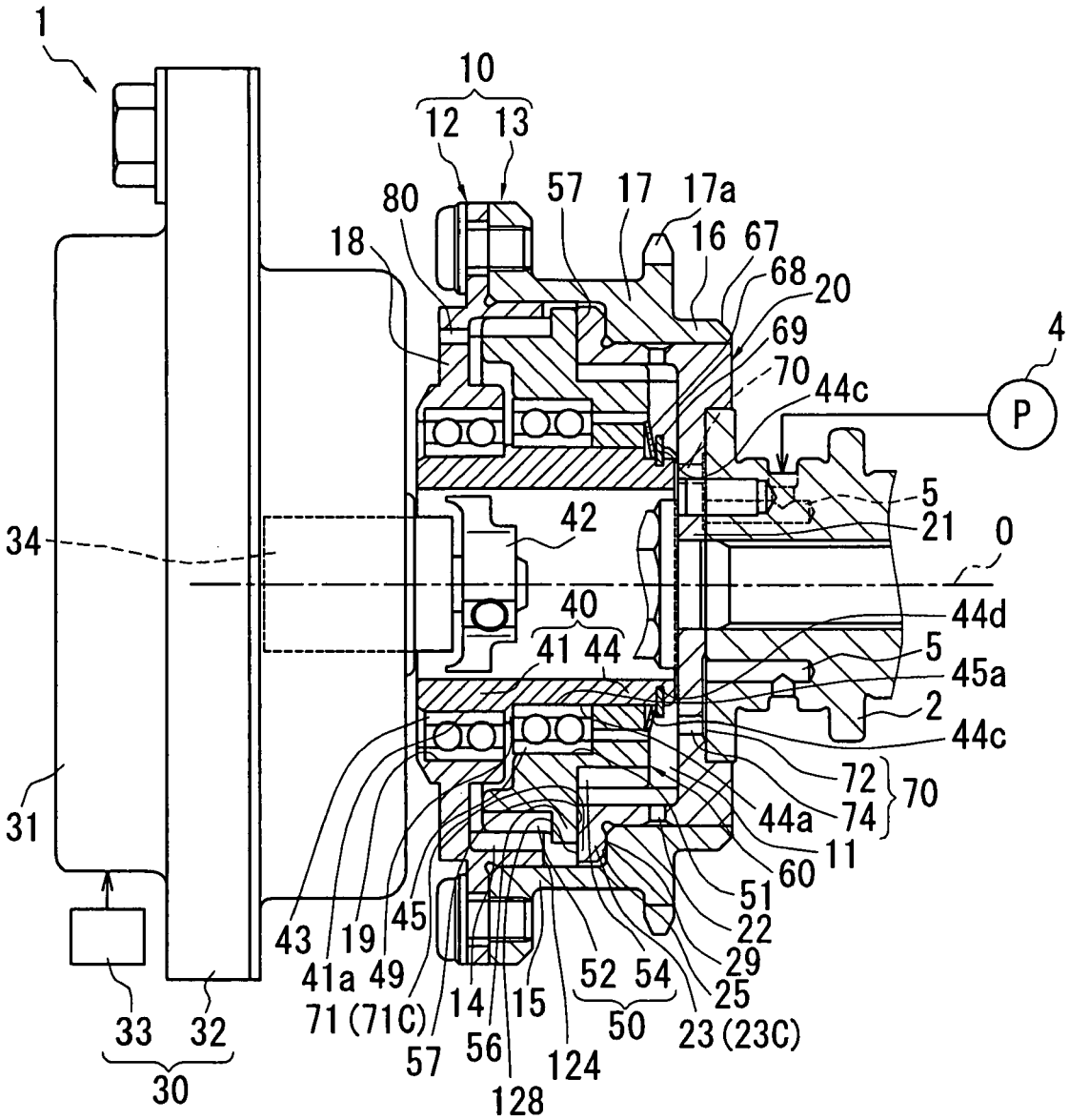
FIG. 9 is a cross section showing a valve timing controller according to a fourth embodiment of the present invention.

Alternatively, in a fourth embodiment, the function of the thrust receiving surface described above is provided, as shown in FIG. 9, on an extension part 56 which is provided as extending between the driving side external gear part 52 and the driven side external gear part 54. It should be noted that, FIG. 9 shows only one pair composed of the stopper 23C and the thrust groove 71 C out of the stoppers described above for drawing composition. Hereinafter, description is made of the one pair of the stopper 23C and the thrust groove 71C, omitting the descriptions of the other pairs.

As shown in FIG. 9, in the planetary gear 50, an extension part 56 extends between the driving side external gear 52 and the driven side external gear part 54 in the radial direction. The extension part 56 is provided between the driving side external gear part 52 and the driven side external gear part 54. The extension part 56 extends in the radial direction along both surfaces 124 and 128 of the thrust groove 71C.

An axial end surface 57 of the extension part 56 is arranged to be able to contact with the axial end surface 128 of the stopper 23C, and constitutes the thrust-receiving surface of the stopper 23C.

Even if thus arranged, the same advantages as the third embodiment can be obtained.

Fifth Embodiment

Figure 10:
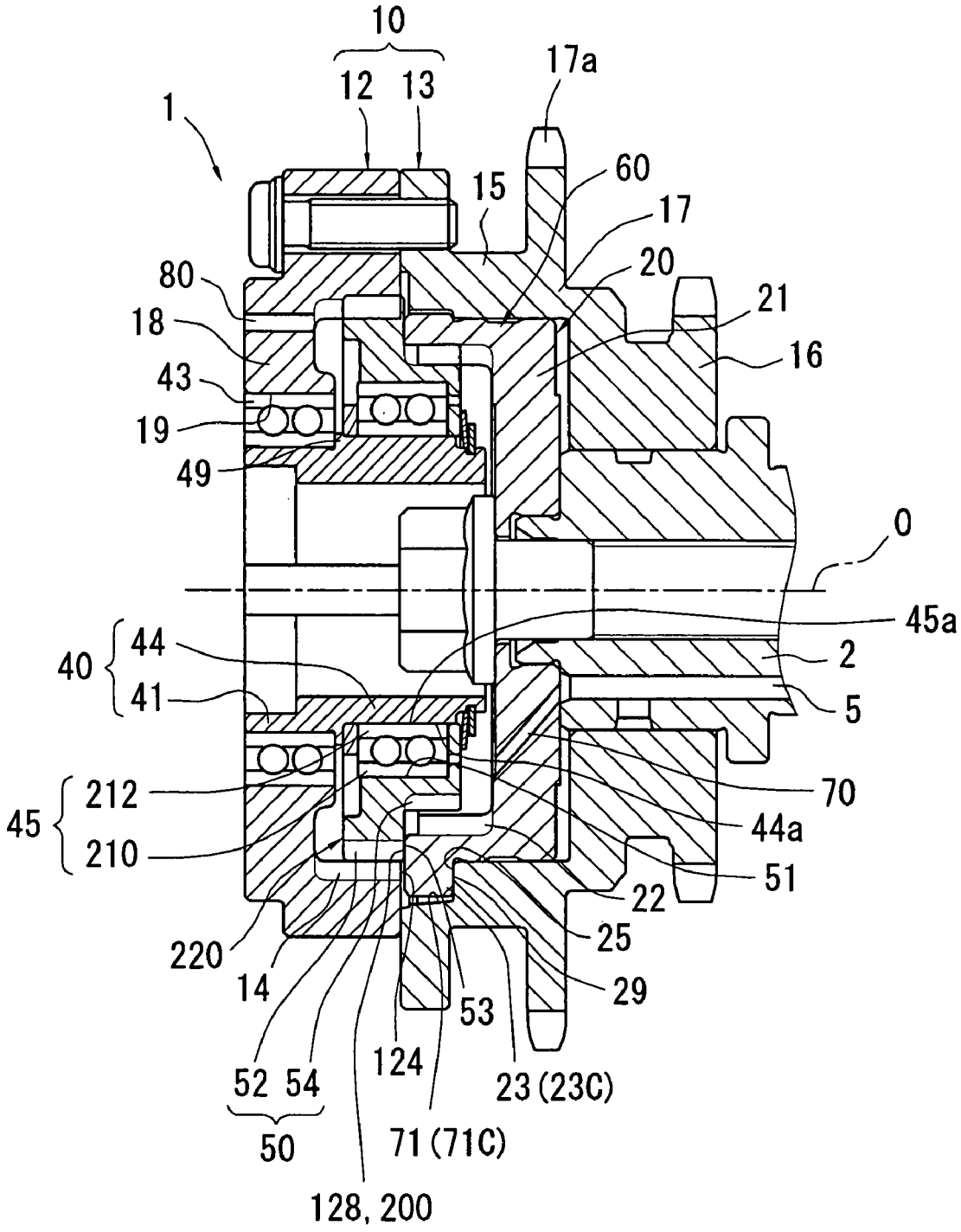
FIG. 10 is a cross section showing a valve timing controller according to a fifth embodiment of the present invention.

A fifth embodiment is a modification of the third embodiment. As shown in FIG. 10, in the fifth embodiment, as is similar to the third embodiment, an axial end surface 200 of the driven-side internal gear part 22 including the end surface 128 contacts on the axial end surface 53. A micro thrust clearance is formed between the end surfaces 53 and 200. The planetary gear 50 and the driven-side rotary element 20 can rotate relatively with each other.

Further, as shown in FIG. 10, in the fifth embodiment, an outer race 210 of the bearing 45 is press-fitted into the inner periphery side of a center hole 51 of the planetary gear 50. An inner race 212 of the bearing 45 is engaged with the outer periphery side of the eccentric part 44 of the planetary frame 40. Thereby, the planetary gear 50 and the bearing 45 are integrated to form a planetary rotary element 220. The planetary rotary element 220 is supported by the planetary frame 40 in a state where a micro clearance is formed between the outer periphery 44*a* of the eccentric part 44 and the inner periphery 45*a* of the inner race 212 of the bearing 45.

Figure 11:
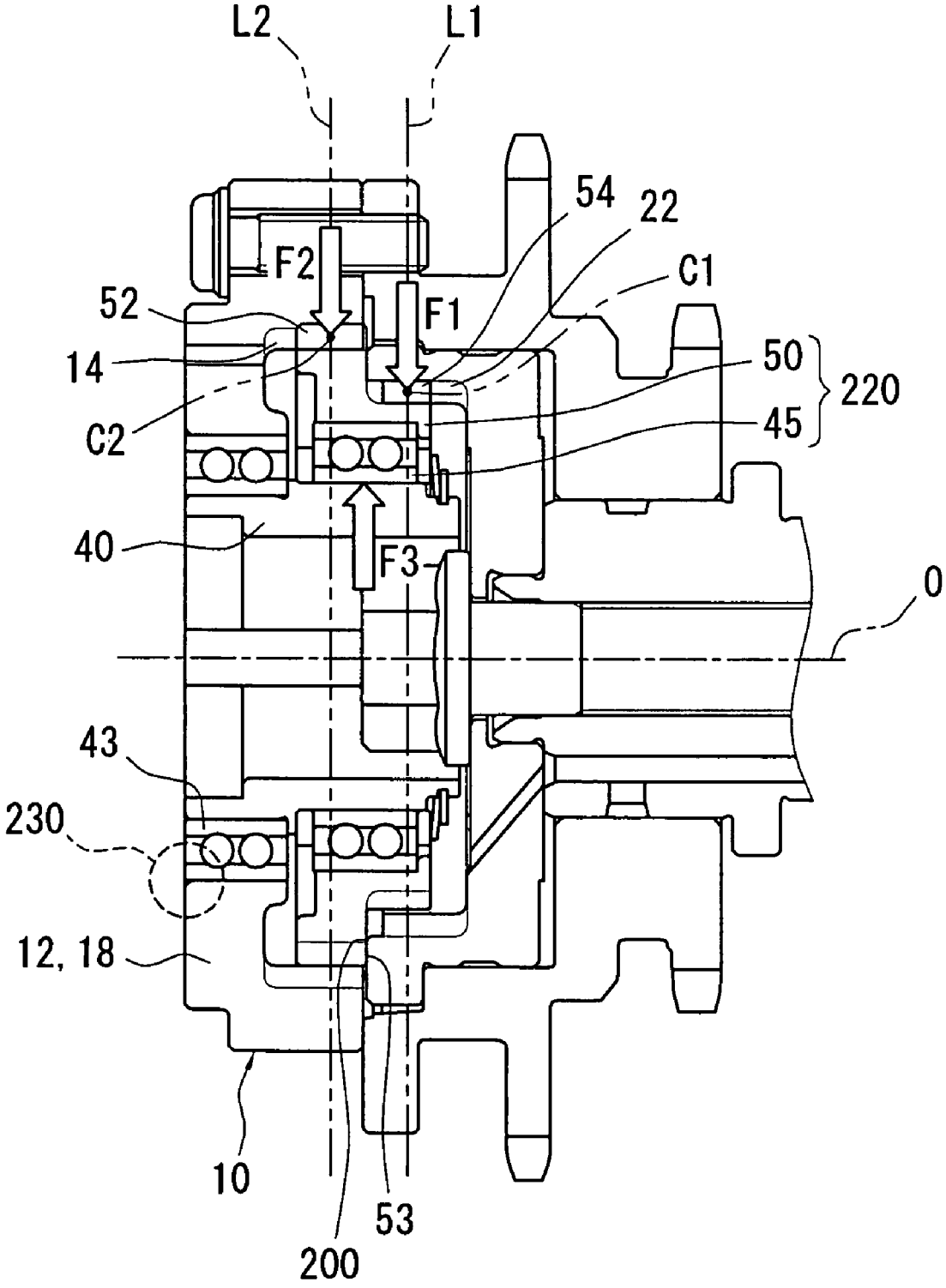
FIG. 11 is a cross-sectional schematic view for explaining a characteristic portion of the valve timing controller according to the fifth embodiment of the present invention.

Furthermore, as shown in FIG. 11, in the fifth embodiment, the planetary frame 40 supports the planetary rotary element 220 on an projection line L1 where a tooth bearing center C1 in the axial direction of the driven-side internal gear part 22 and the driven side external gear part 54 is projected in the radial direction. Moreover, also on a projection line L2 where a tooth bearing center C2 in the axial direction of the driving-side internal gear part 14 and the driving side external gear part 52 is projected in the radial direction, the planetary frame 40 supports the planetary rotary element 220. As a result, the supporting portion of the planetary rotary element 220 in the planetary frame 40 is surely positioned on the inner periphery side of both of the tooth bearing centers C1 and C2. It should be noted that in a schematic cross section of FIG. 11, in order to make understanding of a characteristic portion easier, a hatching, which shows a cross section, is omitted for convenience.

In the supporting form of such characteristics, a radial load F1 generated by engagement between the gear parts 22 and 54 acts on the planetary rotary element 220 along the projection line L1 of the tooth bearing center C1, as shown in FIG. 11. Further, a radial load F2 generated by engagement between the gear parts 14 and 52 acts on the planetary rotary element 220 along the projection line L2 of the tooth bearing center C2. Here, a reactive force F3 which balances with both of the radial loads F1 and F2 is given to the planetary rotary element 220 from the planetary frame 40, since the supporting portion of the planetary rotary element 220 in the planetary frame 40 is positioned on the inner periphery side of the centers C1 and C2. As a result, the planetary rotary element 220 becomes more difficult to incline relative to the normal axial direction substantially parallel with the rotational axial line O. Therefore, generation of the thrust load can be restrained between the gear parts 22, 54 and the gear parts 14, 52.

Moreover, the axial end surface 53 of the driving side external gear part 52 of the planetary gear 50 which comprises the planetary rotary element 220 is contacted on an axial end surface 200 of the driven-side internal gear part 22. The inclination of the planetary rotary element 220, and even generation of the thrust loads between the gear parts 22 and 54 as well as between the gear parts 14 and 52 can also be restrained.

As described above, in the fifth embodiment, generation of the thrust load between the gear parts 22 and 54 or between the gear parts 14 and 52 is restrained, and thereby shortening of the lifetime of the bearing 45 subject to such thrust load can be prevented. Further, due to the thrust load generation restraining action, it becomes unnecessary to provide a dislocation-stopper of the bearing 43 on a portion encircled by a dotted line 230 in FIG. 11 in the bottom wall part 18 of the gear member 12. According to the fifth embodiment, a reduction in size in the axial direction, a reduction in production cost can be realized, simultaneously with high durability.

In addition, in the fifth embodiment, the planetary motion of the planetary rotary element 220 is performed without obstruction because of the restraining of the inclination of the planetary rotary element 220, thereby causing maintenance of the normal relative rotational movement state by the planetary motion.

Other Embodiment

The present invention can be applied and implemented in a variety of embodiments within the scope without departing from the spirit of the present invention.

(1) In the embodiment above described, description is made of the valve timing controller 1 for adjusting valve timing of the intake valve. The present invention may also be applied to a device for adjusting valve timing of the exhaust valve, and a device for adjusting the valve timing of both of the intake valve and the exhaust valve. Besides, in the embodiment above described, description is made of the valve timing controller 1 in which the rotary element 10 is linked to a motion of the crankshaft and the rotary element 20 is linked to a motion of the camshaft 2. However, it may be arranged such that the rotary element 10 is linked to a motion of the camshaft 2 and the rotary element 20 is linked to a motion of the crankshaft.

(2) Besides, in the embodiment above described, the driving-side internal gear part 14 and the driven-side internal gear part 22 which are neighbored in the axial direction are mutually contacted. However, the present embodiment is not limited thereto. These driving-side internal gear part 14 and driven-side internal gear part 22 may be arranged in the axial direction with a clearance therebetween.

(3) Besides, the embodiment above described is provided with the urging member 68 for urging the planetary gear 50 toward the support member (planetary frame) 40 for axially movably supporting. The embodiment is not limited thereto. The urging member 68 may not be provided.

(4) Besides, the embodiment above described is structured such that the stoppers 23A, 23B, 23C are provided as extending on the driven-side rotary element 20, and the thrust grooves 71A, 71B, and 71C are formed on the driving-side rotary element 10. The embodiment is not limited thereto. The stopper 2 may be provided as extending on the driving side rotary element, and the thrust groove may be formed on the driven side rotary element.

(5) Besides, the embodiment described above is structured such that the interposing assembler for interposing the stoppers 23A, 23B, 23C in the axial direction is provided on the driving-side rotary element 10 for interposing them into the thrust grooves 71A, 71B, and 71C. Alternatively, the interposing assembler is provided on the driving-side rotary element 10 and the planetary gear 50 for interposing it by the end surfaces 53 and 57 of the planetary gear 50 and the thrust grooves 71A, 71B, 71C. However, the embodiment is not limited to such arrangements. As long as there is provided an interposing assembler which relatively rotatably interposes the stopper extending on either one of the element 10 and the element 20 in the axial direction, any structure of the interposing assembler provided either on the other rotary element or between the other rotary element and the planetary gear may be used.

Figure 12:
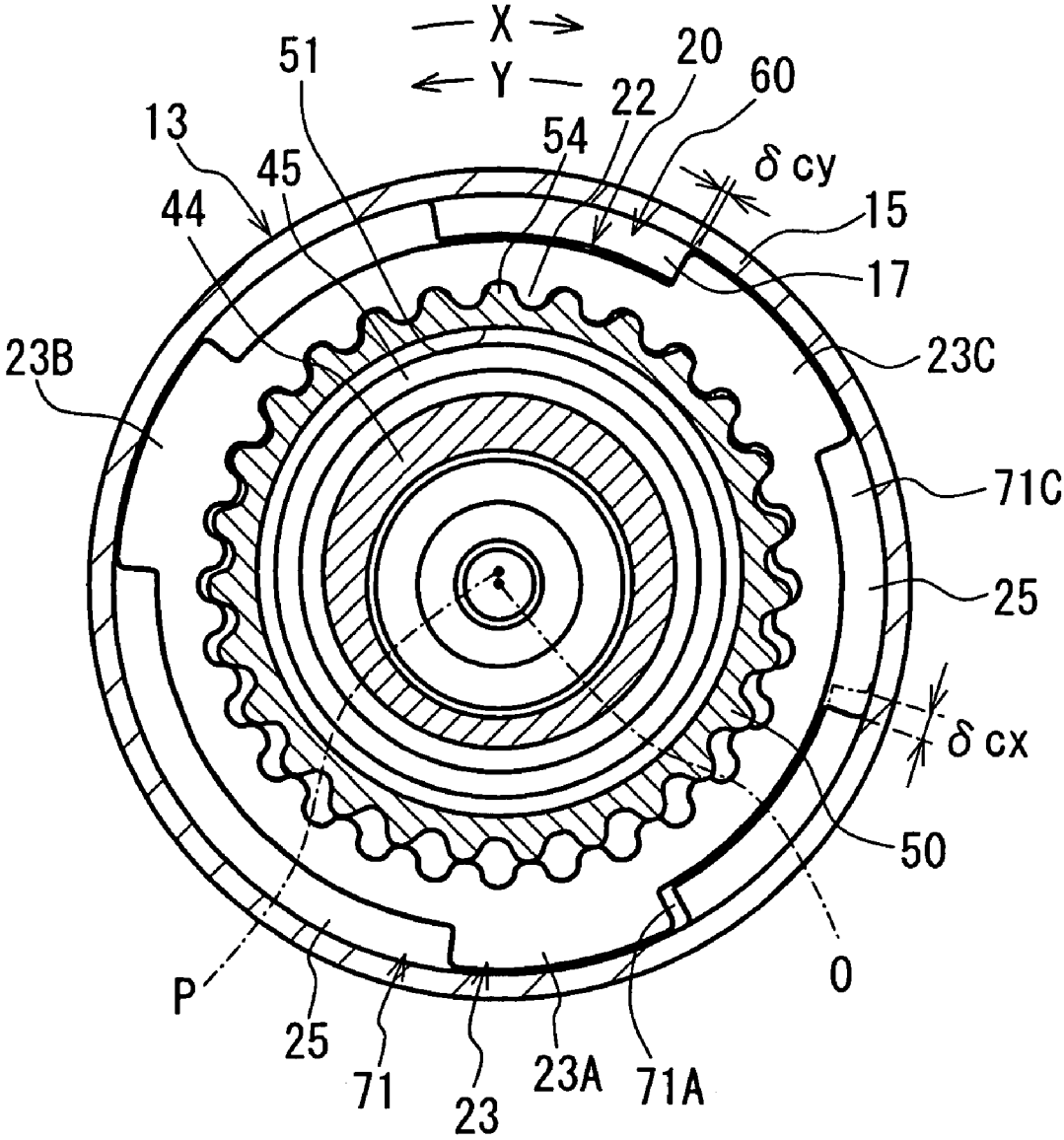
FIG. 12 is a cross section showing a valve timing controller according to another embodiment of the present invention.

(6) Besides, in the embodiment described above, a plurality of pairs of the stoppers 23A, 23B, 23C of the stopper grooves 71A, 71B, 71C are provided. However, the embodiment is not limited thereto. A plurality of stoppers may be provided irrespective of the number of the stopper grooves (refer to FIG. 12). In this case, the plurality of stoppers can be provided at equal intervals in the relative rotational direction. Even with such arrangement, the thrust clearances indicating the thrust direction movement quantity of the driven-side rotary element 20 relative to the driving-side rotary element 10 can be made uniform over the entire periphery in the relative rotational direction.

(7) Besides, the embodiment described above is structured to include the dividing rotary element for dividing the driving-side rotary element 10 into two pieces in the axial direction and define the thrust groove by the axial end surface 24 of the driving-side internal gear part 14 of the fixed member 13 which is the one dividing rotary element. The structure is not limited thereto. The dividing rotary element may be of any structure so long as the thrust groove is defined by the two axial end surfaces of the dividing rotary element.

(8) Further, in the second embodiment described above, the clearance adjusting member 90 is provided in the clearance between the axial end surface 24 of the driving-side internal gear part 14 and the stopper 23C. The structure is not limited thereto. The clearance adjusting member 90 may be a clearance between any of the axial end surfaces and the stopper part 14 so long as the axial end surfaces of the dividing rotary element is used.

Figure 13:
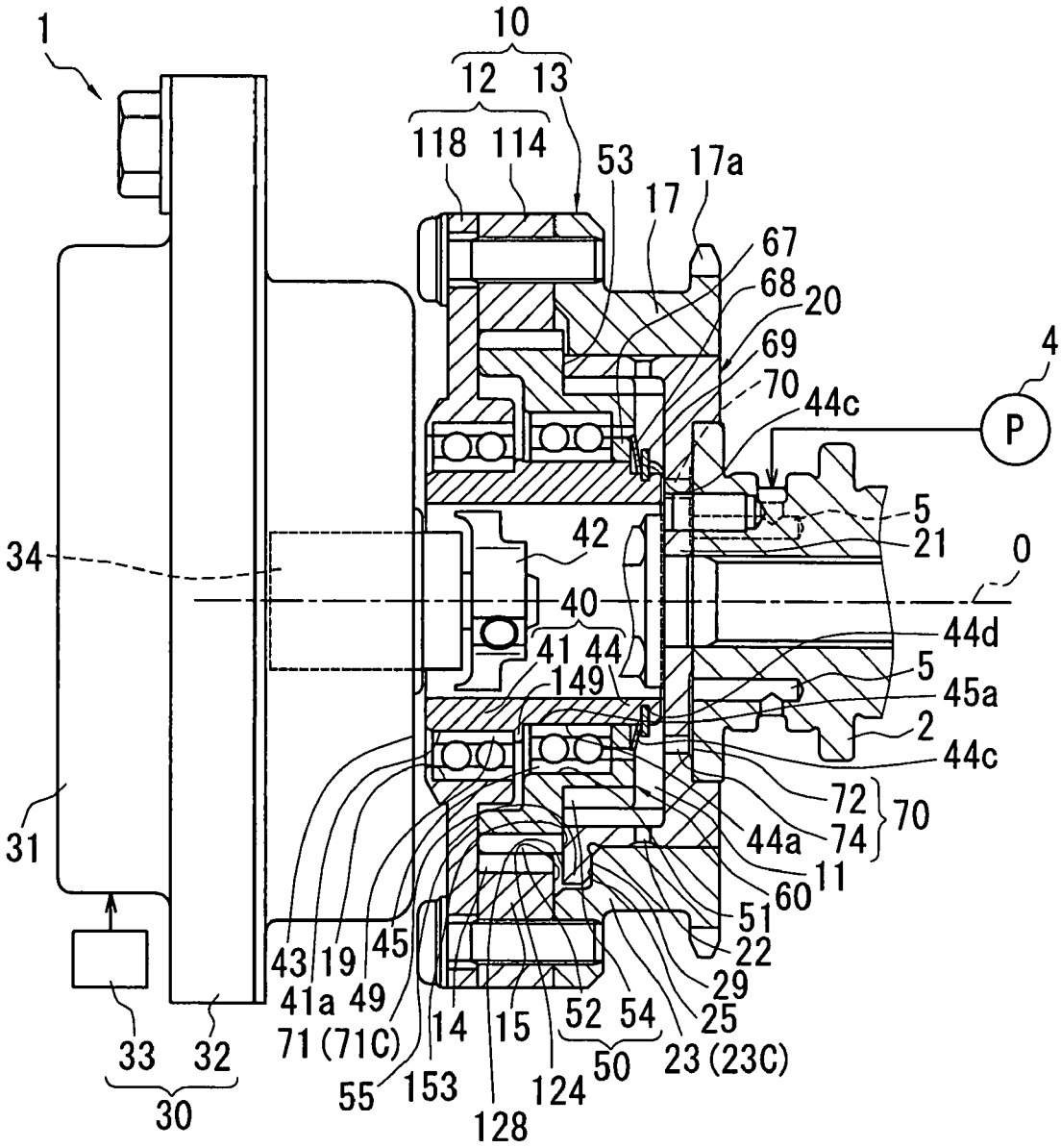
FIG. 13 is a cross section showing a valve timing controller according to another embodiment of the present invention.

(9) Furthermore, in the embodiment above described, the gear member 12 including the driving side inside gear part 14 and the bottom wall part 18 is screwed on the sprocket 13 in a state where the driving side inside gear part 14 and the bottom wall part 18 are formed in integration. The outer circumference wall of the driving side inside gear part 14 is engaged with the inner circumference wall of the larger diameter portion 15 of the sprocket 13. The gear member 12 is not limited to the one formed by the driving side inside gear part 14 and the bottom wall part 18 in integration, and may be structured so as to form the driving side inside gear part and the bottom wall part as separate parts. For example, as shown in FIG. 13, the gear member 12 may be structured such that the driving side inside gear part 114 and the bottom wall part 118 are formed with separate members. The driving side inside gear part 114 is interposed and screwed between the bottom wall part 18 and the larger diameter portion 15 of the sprocket 13.

(10) Moreover, in the embodiment described above, the stoppers 23A, 23B, 23C of the driven-side rotary element 20 are interposed in the axial direction by the thrust grooves 71A, 71B, 71C provided on the sprocket 13 as the driving-side rotary element 10 and the axial end surface 53 of the driving side external gear part 52 as the planetary gear 50. The planetary gear 50 contacts with the engagement part 49 provided on the planetary frame (supporting member) 40 through the bearing 45. The axial end surface 53 of the driving side external gear part 52 effectively achieves the function of the thrust-receiving surface of the stoppers 23A, 23B, 23C.

In contrast, for example, as shown in FIG. 13, when an axial clearance is produced between the bearing 45 and the engagement part 149, an end part 55 opposite to the axial end part 153 of the driving side external gear part 52 is designed to be contacted on the bottom wall part 118. The axial end part 153 can effectively achieve the function of the thrust receiving surface of the stoppers 23A, 23B, 23C.

(11) In a case where the axial clearance is produced between the bearing 45 and the engagement part 45 as described above, the second thrust clearance between the planetary frame 40 and the planetary gear 50 can be reduced by a way that the opposing end part 55 is contacted on the bottom wall part 118. This method may also be applied to another embodiment corresponding, for example, to the first embodiment (refer to FIG. 14). It should be noted that, in FIG. 14, the axial end surface 24 of the driving-side internal gear 114 achieves the function of the thrust-receiving surface of the stoppers 23A, 23B, 23C. A clearance is provided between the axial end part 253 and the axial end surface 28.

(12) In the fifth embodiment, the size relationship between the diameters of the internal gear parts 14 and 22 mutually deviating in the axial direction may be reversed from the one shown in FIG. 10. The size relationship between the diameters of the external gear parts 52 and 54 mutually deviating in the axial direction may also be reversed from the one shown in FIG. 10. Further, in the fifth embodiment, at least one of the external gear parts 52 and 54 and at least one of the internal gear parts 14 and 22 corresponding thereto may be respectively modified with the internal gear parts and the external gear parts.

(13) In the fifth embodiment, instead of providing the bearing 45, the planetary gear 50 may be structured to be directly supported by the planetary frame 40 to position the supporting portion on the inner periphery side of the tooth bearing centers C1 and C2. Further, in the fifth embodiment, the inner race 212 of the bearing 45 is press-fitted into the outer periphery side of the planetary frame 40. The outer race 210 of the bearing 45 may be structured to be engaged with the inner periphery side of the planetary gear 50, thus supporting the planetary gear 50 on the inner periphery side of the tooth bearing centers C1 and C2 by the bearing 45 integral with the planetary frame 40.

Figure 14:
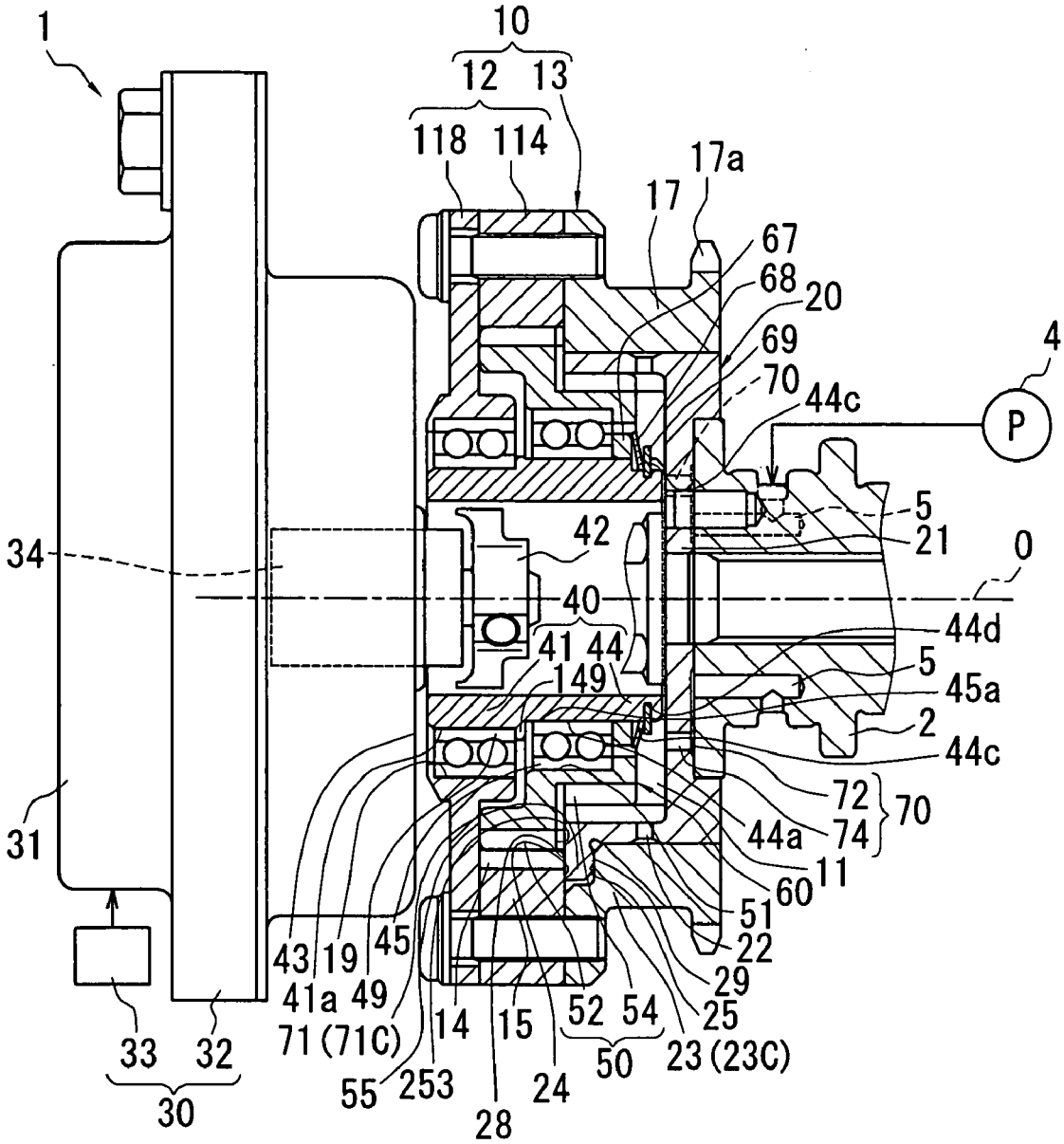
FIG. 14 is a cross section showing a valve timing controller according to another embodiment of the present invention.

(14) In the fifth embodiment, the axial end surface 200 of the driven side gear part 22 in the driven-side rotary element 20 may be structured not to contact with the axial direction end surface 53 of the driving side external gear part 52. Furthermore, in the fifth embodiment, the driving-side rotary element 10 may be structured to contact with the axial end surface of the driving side external gear part 52, as shown in FIGS. 13 and 14. Further, the rotary elements 10 and 20 may be structured to contact with the axial end surface of the driven side external gear part 54 (not shown).

While only the selected example embodiments have been chosen to illustrate the present invention, it will be apparent to those skilled in the art from the disclosure that various changes and modifications can be made therein without departing from the scope of the invention as defined in the appended claims. Furthermore, the foregoing description of the example embodiments according to the present invention is provided for illustration only, and not for the purpose of limiting the invention as defined by the appended claims and their equivalents.

What is claimed is:

1. A valve timing controller for controlling a valve timing of at least one of an intake valve and an exhaust valve which is opened/closed by a camshaft by torque transmitted from a crankshaft, comprising:

a first rotary element including a first gear part for rotating in response to one of the crankshaft and the camshaft;

a second rotary element including a second gear part neighboring to the first gear part in the axial direction for rotating in response to the other of the crankshaft and the camshaft;

a third rotary element including a third gear part and a fourth gear part, the third gear part and the fourth gear part being meshed respectively with the first gear part and the second gear part and performing a planetary motion to vary a relative rotational phase between the first rotary element and the second rotary element;

a stopper radially extending in one rotary element of the first rotary element and the second rotary element for regulating a relative rotational phase shift angle between the first rotary element and the second rotary element; and an interposing assembler provided either at an other rotary element of the first rotary element and the second rotary element or between the other rotary element and the third rotary element for rotatably interposing the stopper of the one rotary element in the axial direction.

2. A valve timing controller according to claim 1, wherein the stopper circularly extends inside of the interposing assembler along the relative rotational direction.

3. A valve timing controller according to claim 1, wherein a plurality of the stoppers are arranged in the interposing assembler over the circumferential direction.

4. A valve timing controller according to claim 3, wherein: the plurality of the stoppers are arranged at equal intervals over the entire circumference in the relative rotational direction.

5. A valve timing controller according to claim 1, wherein the interposing assembler has a thrust groove extending in the circumferential direction along with the relative rotational direction of the stopper.

6. A valve timing controller according to claim 5, wherein a plurality of sets of the thrust grooves and the stoppers are provided.

7. A valve timing controller according to claim 5, wherein the interposing assembler includes a dividing rotary element which divides the other rotary element into two pieces in the axial direction; and the thrust groove is defined by two end surfaces of the dividing rotary element opposing with each other.

8. A valve timing controller according to claim 7, wherein a clearance adjusting member is provided between the end surfaces to be interposed between either one of the end surfaces and the stopper.

9. A valve timing controller according to claim 5, wherein the thrust groove is open so as to extend in the circumferential direction along an inner wall of the other rotary element.

10. A valve timing controller according to claim 5, wherein the interposing assembler is formed of the other rotary element and the third rotary element; and the stopper is interposed in the axial direction between the third rotary element and the end surface at the opposite side of the third rotary element out of the end surfaces of the thrust groove in a state where the stopper is accommodated into the thrust groove.

11. A valve timing controller according to claim 1, wherein the third rotary element is a planetary gear accommodated between the first rotary element and the second rotary element.

12. A valve timing controller according to claim 11, wherein an axial movement of the stopper is regulated by any one of an axial end surface of the gear part provided on the other rotary element, an axial end surface of either one of the third gear part and the fourth gear part of the third rotary element, and an extension part extending between the third gear part and the fourth gear part.

13. A valve timing controller for controlling a valve timing of at least one of an intake valve and an exhaust valve which is opened/closed by a camshaft by torque transmitted from a crankshaft, comprising:

a first rotary element including a first gear part for rotating in response to one of the crankshaft and the camshaft;

a second rotary element including a second gear part neighboring to the first gear part in the axial direction for rotating in response to the other of the crankshaft and the camshaft; and a third rotary element including a third gear part and a fourth gear part, the third gear part and the fourth gear part being meshed respectively with the first gear part and the second gear part and performing a planetary motion to vary a relative rotational phase between the first rotary element and the second rotary element;

a stopper provided so as to radially extend in one rotary element of the first rotary element and the second rotary element for regulating a relative rotational phase shift angle between the first rotary element and the second rotary element; and an interposing assembler provided at the other rotary element of the first rotary element and the second rotary element for rotatably interposing the stopper of the one rotary element in the axial direction.

14. A valve timing controller according to claim 13, wherein:

the interposing assembler includes a dividing rotary element which divides the other rotary element into two pieces in the axial direction and integrates them into one piece and a thrust groove defined by two end surfaces of the dividing rotary element opposing with each other; and the thrust groove interposes the stopper in the axial direction.

15. A valve timing controller for controlling a valve timing of at least one, of an intake valve and an exhaust valve which is opened/closed by a camshaft by torque transmitted from a crankshaft, comprising:

a first rotary element including a first gear part for rotating in response to one of the crankshaft and the camshaft;

a second rotary element including a second gear part neighboring to the first gear part in the axial direction for rotating in response to the other of the crankshaft and the camshaft; and a third rotary element including a third gear part and a fourth gear part, the third gear part and the fourth gear part being meshed respectively with the first gear part and the second gear part and performing a planetary motion to vary a relative rotational phase between the first rotary element and the second rotary element;

a stopper radially extending in one rotary element of the first rotary element and the second rotary element for regulating a relative rotational phase shift angle between the first rotary element and the second rotary element; and an interposing assembler structured by the other rotary element of the first rotary element and the second rotary element and the third rotary element for rotatably interposing the stopper of the one rotary element in the axial direction.

16. A valve timing controller according to claim 15, wherein:

the interposing assembler includes a dividing rotary element which divides the other rotary element into two pieces in the axial direction and integrates them into one piece and a thrust groove defined by two end surfaces of the dividing rotary element opposing with each other; and the interposing assembler interposes the stopper in the axial direction between the third rotary element and the end surface of the thrust groove in a state where the stopper is accommodated in the thrust groove.

17. A valve timing controller for adjusting a valve timing of at least one of an intake valve or an exhaust valve which is opened/closed by a camshaft by torque transmitted from a crankshaft, comprising:

a first rotary element including a first gear part for rotating in synchronization with the camshaft, a second rotary element including a second gear part for rotating in response to the crankshaft, a planetary rotary element including a third gear part and a fourth gear part, the third gear part and the fourth gear part being meshed respectively with the first gear part and the second gear part and performing a planetary motion to vary a relative rotational phase between the first rotary element and the second rotary element; and a planetary frame for supporting the planetary rotary element in such a manner as to perform the planetary motion at the inner periphery side of both of a first center and a second center, in a case that a tooth bearing center with the first gear part and the third gear part in the axial direction is made as a first center, and a tooth bearing center with the second gear part and the fourth gear part in the axial direction is made as a second center.

18. A valve timing controller according to claim 17, wherein:

the planetary frame supports the planetary rotary element on a projection line in the radial direction of the first center and on a projection line in the radial direction of the second center.

19. A valve timing controller according to claim 17, wherein:

the first rotary element or the second rotary element rotatably contacts with an end surface in the axial direction of at least one of the third gear part and the fourth gear part.

* * * * *